US007084337B1

(12) United States Patent
Schroeder

(10) Patent No.: US 7,084,337 B1
(45) Date of Patent: Aug. 1, 2006

(54) ERGONOMIC STRINGED INSTRUMENT

(76) Inventor: Thomas Hermann Schroeder, 875 W. Lucas, Beaumont, TX (US) 77706

( * ) Notice: Subject to any disclaimer, the term of this patent is extended or adjusted under 35 U.S.C. 154(b) by 56 days.

(21) Appl. No.: 10/665,086

(22) Filed: Sep. 17, 2003

Related U.S. Application Data

(60) Provisional application No. 60/411,276, filed on Sep. 17, 2002.

(51) Int. Cl.
*G10D 1/02* (2006.01)

(52) U.S. Cl. ..... 84/274; 84/278; 84/327; 84/304

(58) Field of Classification Search ..... 84/314 N, 84/314 R, 274, 275, 278, 327, 328, 280, 84/291, 290, 304
See application file for complete search history.

(56) References Cited

U.S. PATENT DOCUMENTS

| | | | | | |
|---|---|---|---|---|---|
| 2,814,229 | A | * | 11/1957 | Vaccaro | 84/327 |
| 3,969,971 | A | | 7/1976 | Delu | |
| 4,370,911 | A | | 2/1983 | Goldner | |
| 4,534,260 | A | | 8/1985 | Burrell | |
| 4,586,418 | A | | 5/1986 | Stahlhammer | |
| 4,852,450 | A | * | 8/1989 | Novak | 84/314 R |
| D338,222 | S | | 8/1993 | Steinberger | |
| 5,297,771 | A | | 3/1994 | Gilbert | |
| 5,481,956 | A | * | 1/1996 | LoJacono et al. | 84/314 N |
| 5,528,971 | A | * | 6/1996 | Wood | 84/327 |
| 5,664,758 | A | * | 9/1997 | Smith | 248/688 |
| 5,696,338 | A | | 12/1997 | Grissom | |
| 5,780,756 | A | | 7/1998 | Babb | |
| 5,789,687 | A | | 8/1998 | Johnson | |
| D419,587 | S | | 1/2000 | Okamura | |
| 6,034,308 | A | | 3/2000 | Little | |
| 6,156,961 | A | * | 12/2000 | Beckmeier | 84/293 |
| 6,255,565 | B1 | | 7/2001 | Tamura | |
| 6,441,282 | B1 | | 8/2002 | Tamura | |

* cited by examiner

*Primary Examiner*—Jeffrey W Donels
(74) *Attorney, Agent, or Firm*—Thomas Schroeder

(57) ABSTRACT

A stringed instrument having a stationary support; one part of the instrument interfacing with the musician's sternum, another part pivotally interfacing with the support using two pivot axes mounted perpendicular to each other, first axis dependent on second axis. The longitudinal axis of the instrument is aligned with the musician's anatomical median plane; the support enabling congruent movement between the instrument and the musician's swaying torso while preventing rotation of the instrument around its longitudinal axis, thus improving ergonomic posture and technique. The instrument has an effective string length less than that of a cello and greater than that of a viola, for enabling such ergonomic positioning.

The instrument further has a non-traditional nut-bridge configuration for a more ergonomic fingerboard topology and alignment of known points of contact; further, the instrument has a modular fingerboard for simplified assembly and convenient interchange of either the fingerboard or the instrument; further, the instrument has a geared tuning system, enabling tuning by sliding a finger tangentially along a wheel, for more intuitive tuning by translating linear pitch perception into linear finger motion.

29 Claims, 28 Drawing Sheets

ERGONOMIC STRINGED INSTRUMENT

CROSS-REFERENCE TO RELATED APPLICATIONS

This application claims the benefit of PPA 60/411,276, filed 2002 Sep. 17 by the present inventor.

BACKGROUND

1. Field of Invention

The present invention relates to a stringed musical instrument—having a support—that facilitates playing in a more ergonomic manner than known stringed musical instruments, thereby improving the musician's comfort and ease in playing the instrument.

2. Discussion of Prior Art

With greater understanding of human biomechanics, musicians strive to make their playing more ergonomic; comfort and ease of playing are ever more important in achieving better results. Any improvement of the interface between the musical instrument and the human body must be achieved without violating principles of human biomechanics (i.e., without imposing unnatural body positions, motions, or restrictions).

The dimensions of the instruments of the violin family (violin, viola, cello, and bass) are dictated by acoustical requirements of the strings and the appropriate resonating body; lower pitched instruments require longer strings and a larger resonance body. Built to meet the resulting structural requirements, these instruments are not designed for the comfort and ease of use of the musician. Further, many years of tradition have resulted in instrument makers doing little to improve the interface between instrument and musician; it is the musicians who are constantly advancing the playing technique to achieve greater comfort and ease while playing. Victor Sazer's Book, "New Directions in Cello Playing: How to Make Cello Playing Easier and Play Without Pain," is an example of an attempt to improve the playing technique in order to compensate for (not remedy) the known problems of said interface.

The cello has several unfavorable structural features that hinder the playing of the instrument. Cellists are known to have a high incidence of back pain and carpal tunnel syndrome, and in 1992 the Juilliard School of Music established an on-campus staff of physical therapists to treat performance-related injuries.

Although cellos can be built to fit a specific person, most are built for the non-existent "average person"; i.e., in a size and shape that is a compromise for every musician. Further, even though cellos can be made in different sizes, the proportions of the component parts remain the same such that some of the problems caused by the size and shape of the cello are not addressed.

For instance, although the height and angle (relative to the human body) of the instrument can be adjusted by changing the length of the protruding endpin section, the adjustment must still find a compromise between the comfort of the musician's right and left hands, legs and chest, and the position of the instrument's head relative to the musician's head.

Another problem is the biased orientation of the cello (as well as other string instruments) in favor of either the left arm's comfort or the right arm's comfort; i.e., the cello is tilted either toward the left side, allowing a more ergonomic range of motion for the musician's left arm, or toward the right side, allowing a more ergonomic range of motion for the right arm. U.S. Pat. No. 4,534,260 to Burrell (1985) and U.S. Pat. No. 6,034,308 to Little (2000) propose a fingerboard structure having a twist along its longitudinal axis to allow more ergonomic motion for both the musician's arms; this approach offers a solution for only part of the fingerboard and it requires elaborate construction.

Further, the cello's longitudinal axis and the longitudinal axis of the instrument's fingerboard can not be positioned on the anatomical median plane of the musician's body, often resulting in a twisted spine, a locked left elbow and string crossings that can not be accomplished in an ergonomic manner. While the instrument's longitudinal axis is usually not identical to the longitudinal axis of the instrument's fingerboard, the playing position and symmetry of a cello imply that the longitudinal axis of the fingerboard can be positioned on the anatomical median plane of the musician's body only if the instrument's longitudinal axis is positioned on said plane.

Other problems with the left hand are well known to instructors and musicians alike. These problems include the unnaturally high position of the left hand in known "lower" positions, the fact that a student does not get visual feedback while playing in these positions, as well as the unnaturally wide spread of the left hand in said positions, requiring constant adjustment of the now non-equidistant finger spread (the human hand has an equidistant finger spread when kept in its natural spread width).

The misalignment of the cello's pivot point (on the floor) and the musician's pivot axis when swaying the upper body from side to side (at about sitting level) changes the position of the cello relative to the musician's body; thus a musician is forced to choose either to not sway or to develop a technique that adjusts to this always changing interface. Supporting the cello without the use of an endpin—musicians specializing in baroque music often use period instruments without endpins—gives the musician the freedom to move while maintaining the instrument's position relative to position of the human body. However, supporting the instrument's weight with the legs is quite tiresome, the reason why most modern cellists prefer to use an endpin.

The interface between floor and endpin (ball joint type) enables the cello to rotate around its longitudinal axis; the musician must thus constantly maintain the cello's stability by using the legs, chest, and sometimes the left hand. The points of contact (bow-string interfaces) are not located on the instrument's longitudinal axis, causing bow movement to induce disturbance of the instrument's rotational stability.

The use of an endpin is problematic for other reasons as well. The interface between the floor and the endpin must provide enough friction to prevent the endpin from slipping, while the floor surface must be protected. There are many known devices related to this problem; for instance, U.S. Pat. No. 4,370,911 to Goldner (1983) shows a pointless endpin attachment for the cello. Although this support appears to prevent rotation of the instrument around its longitudinal axis, the surface area of attachment contacting the floor is in fact too small to prevent the described rotation. An example of a widely used nonstop endpin holder is shown in U.S. Pat. No. 5,696,338 to Grissom (1997). This device allows the endpin to pivot freely, but permits the undesired rotation around the instrument's longitudinal axis.

Cellos are played in positions that range from vertical to almost horizontal. While the endpin supports most of the instrument's weight in a vertical playing position, the musician has to support more of that weight when approaching a horizontal playing position, because the instrument's center of gravity is not directly supported by the endpin. U.S. Pat.

No. 4,586,418 to Stahlhammer (1986) claims a bent endpin structure, thereby moving the interface between endpin and floor to better support the instrument's center of gravity. While this device reduces the effective weight of the instrument bearing on the musician, the distance between the instrument's rotational pivot axis (defined by the endpin's interface with floor and the instrument's interface with the musician at the chest) and the point of contact (the interface between bow and string) is increased, causing bow movement to induce more disturbance to the instrument's rotational stability. U.S. Pat. No. 5,297,771 to Gilbert (1994) discloses a similar device for the double bass.

A better way of supporting the instrument would be to elevate it by a stationary support, thus moving the instrument's pivot point to just under the instrument, as illustrated in a portrait (c. 1690) painted by Constantin Netscher; shown is a bass viol player standing with the viol supported on a small stool. This approach still fails to prevent the instrument's rotation around its longitudinal axis.

U.S. Pat. No. 2,814,229 to Vaccaro (1957) discloses a musical instrument support that is intended to facilitate playing the violin or viola "positioned astride the thighs" supporting the instrument on the lap with the scroll resting against the neck. Rotation of the instrument around its longitudinal axis remains problematic, as now the player has to use his/her left hand to stabilize the instrument. In addition, this support is not very stable, being based on the player's legs.

U.S. Pat. No. 5,789,677 to Johnson (1998) shows a chair-based instrument support, used for a tuba, freeing the musician's legs from having to support such a heavy instrument. This support is not useful for string players, because it allows the stringed instrument to rotate around its longitudinal axis, thereby restricting the musician's freedom of motion by forcing him/her to stabilize the instrument.

Bassoon players often support their instrument at about seat height using a strap that is tucked under the seat. This free pivoting support works well for the bassoon; rotation around its longitudinal axis is easily controlled by the player's hands.

Another problem of playing a bowed string instrument is the misalignment of known "points of contact". The point of contact describes the ideal point of interface between the bow and the string, all other parameters (bow speed and bow pressure) being constant; the point of contact is different for each string (distance from bridge greater for lower pitched strings). The player must constantly compensate for this misalignment by either adjusting the bow to agree with the point of contact or changing other parameters (such as bow speed and bow pressure) in order to change the point of contact.

The fingerboard topology of string instruments (the arrangement of finger placements on the fingerboard) is determined by the orientation of the nut and the bridge, traditionally being perpendicular to the longitudinal axis of the fingerboard (guitar frets are parallel to the bridge). The natural direction/orientation of the musician's fingers, however, is different for each playing position; especially when playing barred chords, the hand's orientation needs to be adjusted to correspond with the fingerboard topology.

Similar problems are found with other members of the violin family. The violin (or viola) is entirely supported by the musician, thus offering the advantage of moving congruently with the musician's torso. Held between the musician's shoulder and chin, the violin's position—as well as left hand playing technique—is known for its non-ergonomic nature.

While there are many chin and shoulder rests claiming to improve comfort of the musician, only the following two approaches seem to adequately address the problem. U.S. Pat. Des. 338,222 to Steinberger (1993) shows an electric violin with just the essential features, thereby reducing the weight of the instrument. U.S. Pat. No. 5,780,756 to Babb (1998) introduces a new support system utilizing the musician's shoulder and neck but not the chin.

Plucked string instruments also have some of the same disadvantages and limitations. The orientation of the guitar, in particular the fingerboard, often causes problems for the left arm; guitar players who play their instrument in an almost horizontal position have discovered that this position induces considerable stress on the musician's left wrist, resulting in some of the same types of chronic injury as listed above.

An often overlooked problem is the overuse of the left hand's thumb which is used to apply counter pressure for all other playing fingers. For this reason, some guitar players have begun playing their instruments in a position similar to that of a cellist, sometimes even supporting them with an endpin.

The development of the electric pickup provided an opportunity to address some of these ergonomic shortcomings; its ability to amplify the natural volume of an instrument or to even replace the resonating body altogether changes the paradigm of instrument construction.

However, as far as is known, the approach used by the electric string instrument makers has been to imitate both the features and structural dimensions of the acoustic counterpart to make the transition from acoustic to electric an easy one; despite some ergonomic improvements over their acoustic counterparts, most electric instruments imitate the "feel" of the acoustic instrument. U.S. Pat. Des. 419,587 to Okamura (2000), and U.S. Pat. No. 6,255,565 (2001), U.S. Pat. No. 6,414,234 (2002), both to Tamura, show electric instruments with almost traditional instrument body outlines in form of permanent, foldable, or detachable (for storage only) structures, thus still hindering playing comfort.

Innovative electric cello designs by makers such as Jensen and Steinberger have omitted much of the traditional body outline; they do, however, include knee braces, endpin, and chest support, thus still maintaining the playing posture of the acoustic counterpart.

There are some bowed string instruments that are played in positions different from those of the violin family.

The chianuri, or two-string bowed lute, is played with the body of the instrument resting between the musician's legs, but the head of the instrument rests against the shoulder such that the instrument is not positioned on the musician's median plane.

Kirghiz musicians play a two-string fiddle, the kiak, and musicians in the Rajasthan area of Northern India play two bowed lutes, the sindhi-sarangi and gujrati-sarangi, in much the same way.

The kemence, a three-string bowed lute found on the eastern coast of the Black Sea, rests on the player's thigh and leans back against the shoulder, and therefore is not positioned on the player's median plane.

A number of so-called spike fiddles are known, including the Kemane spike fiddle, the esraj, diluba, saringda, chikara, ghichak (Tajikstan), k'amanch'a (Armenia), juza (Iraq), kemanche (Northern India and Azerbaijan), gheichek, or short-necked fiddle (Baluchistan), and rêbab (Java). Spike fiddles are generally held upright on the knee, leaning back against the chest, or with the musician seated cross-legged and the scroll balanced against the upturned right foot and the other end of the instrument under the chin. Like the other instruments listed, they are not positioned on the median plane of the musician's body and therefore do not address many of the disadvantages and limitations described above.

Each instrument of the violin family has a different playing technique; while playing the violin is similar to playing the viola, the cello technique is quite different from that for violin. Most school orchestra teachers are currently teaching all (bowed) string instruments at the same time; having a universal technique for all string instruments would certainly improve the situation. Attempts have been made to develop such string instruments that are alternatives to the instruments of the violin family: U.S. Pat. No. 3,969,971 to Delu (1976) introduces the VIODES system, a family of bowed string instruments of identical overall length, in particular string length, but in graduated widths and depths. While all these instruments can be played using the same technique, they do not offer any ergonomic advantages.

The members of the violin family, being non-fretted string instruments, offer a great advantage over their fretted ancestors by providing total freedom of pitch control for achieving better intonation. This obvious advantage, however, is accompanied by a major drawback: until a musician has mastered the skills of utilizing this freedom of pitch control, poor intonation is a great obstacle to an enjoyable musical experience. Most school orchestra programs suffer from this dilemma, losing numerous students to the band program. While a fretted fingerboard would provide temporary relief, students would eventually have to retrofit their instruments with non-fretted boards once they have achieved sufficient mastery.

OBJECTS AND ADVANTAGES

Accordingly, several objects and advantages of the presentation invention are:

to provide a stringed musical instrument that is comfortable and easy to play, thereby improving playing, teaching, and learning;

to provide a stringed musical instrument that can be played having both hands in front of the torso, thereby facilitating ergonomic movement and improving the comfort and ease of playing;

to provide a stringed musical instrument that can be played having the longitudinal axis of the fingerboard aligned with the musician's anatomical median plane, thereby facilitating ergonomic movement and improving the comfort and ease of playing;

to provide a stringed musical instrument that facilitates left hand operation below shoulder level, thereby improving the left arm's playing comfort;

to provide a stringed musical instrument having a string length that enables the use of an ergonomic finger spread for the widest hand positions (close to the nut), thereby improving comfort and ease of playing for the left hand;

to provide a stringed musical instrument having a string length that enables ergonomic positioning of the entire instrument in front of the musician's body;

to provide a stringed musical instrument having a string configuration that substantially aligns the points of contact (bow-string interface), compensating for the different parameters of each string, thereby improving the ease of string crossings for the right (bow) arm, wrist, hand, and fingers;

to provide a stringed musical instrument that can be fitted with different string configurations, thereby creating a family of instruments that cover a wide range of tonal registers and can be played using a universal technique;

to provide a stringed musical instrument that enables visibility of the entire fingerboard while maintaining an ergonomic playing position, thereby facilitating the use of visual fingerboard guides;

to provide a stringed musical instrument of small overall dimensions, thereby improving storage and transportation of the instrument;

to provide a stringed musical instrument of simple design;

to provide a stringed musical instrument able to interchange its fingerboard;

to provide a stringed musical instrument of durable construction;

to provide a stringed musical instrument having both ends of the fingerboard supported, thus providing stationary stability relative to the musician;

to provide a stationary instrument support system that reduces the effective weight of the instrument bearing on the musician, thereby improving comfort and freedom of movement;

to provide a stationary instrument support system that enables instrument movement congruent with any movement of the musician's torso;

to provide a stationary instrument support system that prevents rotation of the instrument around its longitudinal axis, freeing the musician from having to prevent such rotation, thereby improving comfort and freedom of movement;

to provide a musical instrument having an ergonomic fingerboard topology; i.e., having a system of frets (physical or imaginary) aligned with the natural direction of the musician's left hand, thereby improving comfort and ease in particular for the musician's left wrist; and to provide a stringed musical instrument having a more intuitive tuning system.

Further objects and advantages will be made clear by the following description and drawings.

SUMMARY

These objects are achieved by providing a stringed musical instrument having a stationary support; one part of the instrument interfacing with the musician's sternum, another part interfacing with the support, the longitudinal axis of the instrument aligned with the musician's anatomical median plane; the support enabling congruent movement between the instrument and the musician's swaying torso while preventing rotation of the instrument around its longitudinal axis; the instrument has an effective string length less than that of a cello and more than that of a viola for ergonomic positioning of both left arm and bow arm operations, the instrument further having a non-traditional bridge-nut configuration for a more ergonomic fingerboard topology and alignment of known points of contact; further a modular fingerboard for both convenient interchange of either instrument or fingerboard and for simplified assembly; further a geared tuning system having tuning wheel for more intuitive tuning by sliding a finger tangentially along the wheel.

BRIEF DESCRIPTION OF DRAWINGS

In the drawings, closely related figures have the same number but different alphabetic suffixes.

REFERENCE NUMBERS IN DRAWINGS

Figure 1A:
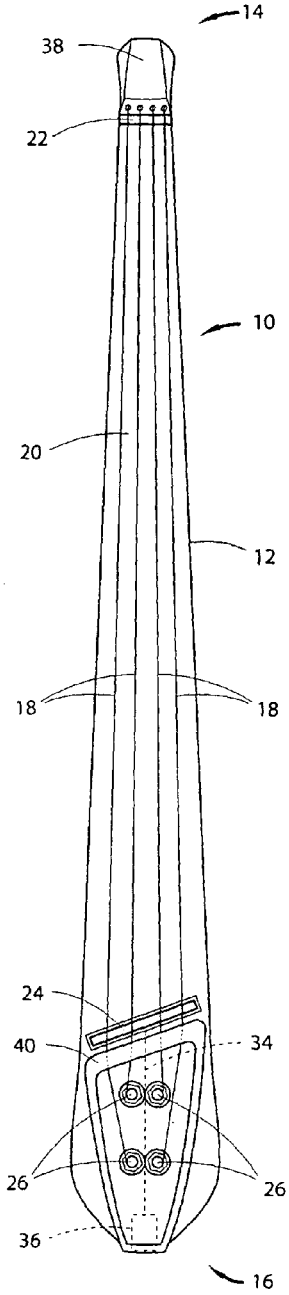
FIGS. 1A to 1C show different views of an embodiment of a musical instrument, constructed in accordance with the teachings of the present invention.
Figure 1B:
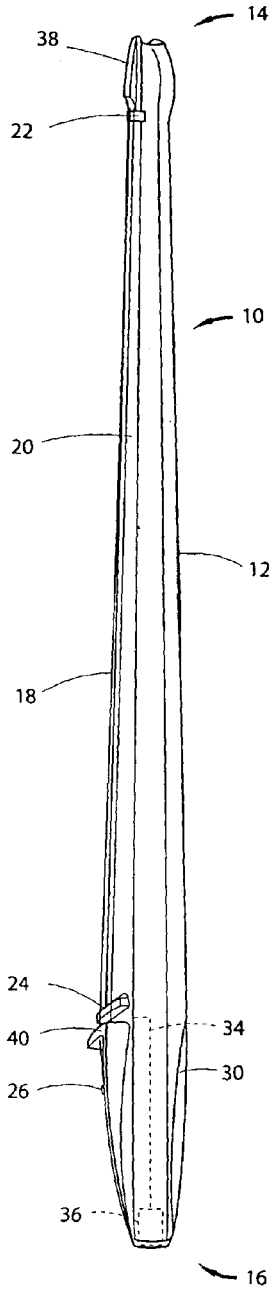

10 instrument
12 body of instrument 10
14 first end of body 12
16 second end of body 12
18 strings of instrument 10
20 fingerboard of instrument 10
22 nut of instrument 10
24 bridge of instrument 10
26 tuning peg of tuner 46
28 tuning knob of tuner 46
30 cover plate of instrument 10
31 visual guide on cover plate 30
32 screws of cover plate 30
34 cable of instrument 10
36 jack of instrument 10
38 protrusion at first end 14
40 ridge at second end 16
42 screw of tuner 46
44 washers of tuner 46
46 tuner of instrument 10
48 drive shaft of tuner 46
50 cavity at first end 14
52 tunnel at first end 14
54 tunnel entrances of tunnel 52
56 tunnel exits of tunnel 52
58 gimbal system of support 60
60 support
62 support member of support 60
64 oval hole of support member 62
66 outer ring of gimbal system 58
68 median ring of gimbal system 58
70 inner ring of gimbal system 58
72 oval periphery of outer ring 66
74 inner surface shape of hole 64
76 pins to connect rings 66–70
78 bores in outer ring 66
80 bores in median ring 68
82 bores in median ring 68
84 bores in inner ring 70
86 inner surface shape of inner ring 70
88 pivot axis of median ring 68 (longitudinal axis of support member 62)
90 pivot axis of inner ring 70
92 longitudinal axis of instrument 10
94 human body
96 median plane of human body 94
98 coronal plane of human body 94
100 horizontal plane of human body 94
102 musician
104 chair
106 bow
108 attachment for first end 14
110 hand, approaching nut
112 hand, approaching bridge
114 orientation of bridge 24
116 orientation of nut 22
118 longitudinal axis of fingerboard 20
120 points of contact between bow 106 and strings 18
122 violin/viola
124 cello
126 double bass
128 bridge of violin 122
130 bridge of cello 124
132 bridge of double bass 126
134 nut of violin 122

136 nut of cello 124
138 nut of double bass 126
140 guitar, classical
142 guitar, non-classical
144 nut of guitar 140
146 nut of guitar 142
148 bridge of guitar 140
150 bridge of guitar 142
152 endpin structure
154 tripod with gimbal system 58
156 acoustic embodiment of instrument 10
158 second end of body 162
160 first end of body 162
162 body of acoustic embodiment 156
164 electric cello
166 first end of body 172
168 second end of body 172
170 chest rest of body 172
172 body of electric cello 164
174 keyboard
176 first end of body 178
178 body of keyboard 174
180 second end of body 178
182 wind instrument
184 first end of wind instrument 182
186 body of wind instrument 182
188 second end of wind instrument 182
190 first alternative support
192 support member of support 190
194 living hinge
196 first axis of living hinge 194
198 second axis of support member 192
200 second alternative support
202 support member of support 200
204 universal joint of support 200
206 first axis of universal joint 204
208 second axis of universal joint 204
210 third alternative support
212 support rods (two) of support 210
214 bores of seat 216
216 seat
218 end points of support rods 212
220 first axis of support 210
222 second axis of support 210
224 fourth alternative support
226 music stand
228 support member of support 224
230 mounting system of support 224
232 fifth alternative support
234 base of fifth alternative support 232
236 slot in seat 216
238 first mount of seat 216
240 sixth alternative support
242 telescopic support member of support 240
244 seventh alternative support
246 curved support member of support 244
248 second mount of seat 216
250 eighth alternative support
252 support member of support 250
254 pin of support member 252
256 modified gimbal system
258 ninth alternative support
260 two-segment support system of support 258
262 hinge of support 258
264 simplified instrument-support unit
266 simplified instrument
268 simplified support
270 hinge for simplified instrument support unit 264
272 strings for unit 264
274 fretted fingerboard of instrument 266
276 child
278 alternative embodiment of instrument 10
280 body of instrument 278
282 fingerboard of instrument 278
284 insert of instrument 278
286 economized head design of instrument 278
288 bass guitar tuners of instrument 278
290 cavity of instrument 278
292 slot for receiving bridge 24 of instrument 278
294 set of four holes of instrument 278
296 potentiometer of instrument 278
298 cavity of insert 284
300 support of instrument 278
302 thin disc magnets of instrument 278
304 cavity system of insert 284
306 thick disc magnets of insert 284
308 ball bearings of body 280
310 mini disc magnets of body 280
312 hemispherical recesses of fingerboard 282 and nut 22
314 support member of support 300
316 ferrous metal cylinder of support 300
318 longitudinal axis of cylinder 316
320 longitudinal axis of support member 314
322 support of instrument 278
324 living-hinge of support 322
326 tongue of living-hinge 324
328 groove of modified insert 330
330 modified insert of embodiment 278
332 axis of living hinge 324
334 longitudinal axis of instrument 278

DESCRIPTION

Preferred Embodiment I

Figure 1C:
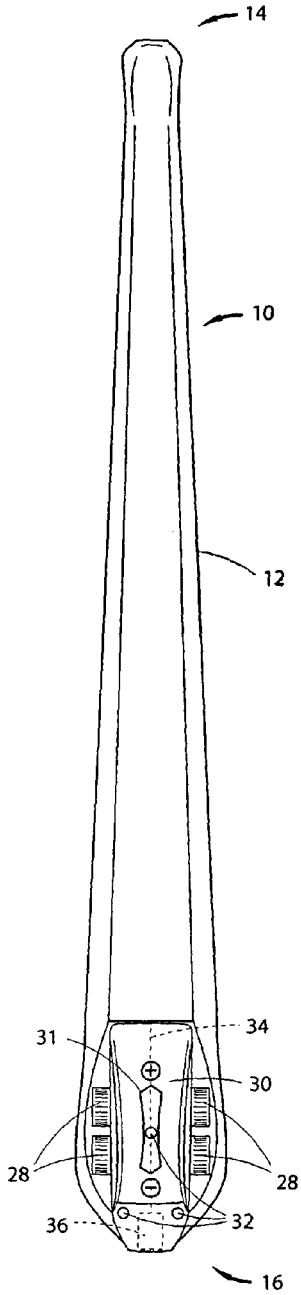

FIGS. 1A (front elevational view), 1B (side elevational view), and 1C (back elevational view) show an embodiment of a musical instrument 10 (generally indicated), constructed in accordance with the teachings of the present invention. Instrument 10 comprises an elongated body 12 having a first end 14 and a second end 16. Strings 18 are suspended over a fingerboard 20 bound by a nut 22 and by a bridge 24 (the non-traditional orientation of bridge 24 is discussed in detail in FIG. 10); strings 18 are held in tension by anchoring at first end 14 of body 12 and winding each around a corresponding peg 26 located near second end 16 of body 12. Pegs 26 are each connected to a corresponding tuning knob 28 that is recessed within body 12 of instrument 10 as shown in FIG. 1C. A cover plate 30 is mounted with three screws 32 at second end 16 of instrument 10 closing a concavity at the back side of body 12 necessary for the recessed integration of tuners (not numbered here, shown in more detail in FIGS. 2A, 2B, and 3). Cover plate 30 has a visual guide 31 imprinted onto its surface indicating the relationship between sliding direction on tuning knob 28 and pitch direction, up or down. A cable 34 (shown in dashed lines) connects bridge 24 (bridge has integrated pickup system, available from R. Barbera in New York, N.Y.) with a jack 36 (shown in dashed lines); jack 36 is mounted into a complementary-shaped bore in/at cover plate 30 (shown in more detail in FIG. 3). Bridge 24, nut 22, and strings 18 are protected by a protrusion 38 (shown in more detail in FIGS. 4A and 4B) of body 12 at first end 14 and a ridge 40 at second end 16; ridge 40 protrudes from body 12 beyond tuning pegs 26, thereby enabling safer handling of instrument 10. Ridge 40 further functions as a string guide redirecting strings 18 through holes (FIG. 1A, strings shown in dashed lines) in ridge 40 from bridge 24 to appropriate tuning pegs 26.

Figure 5A:
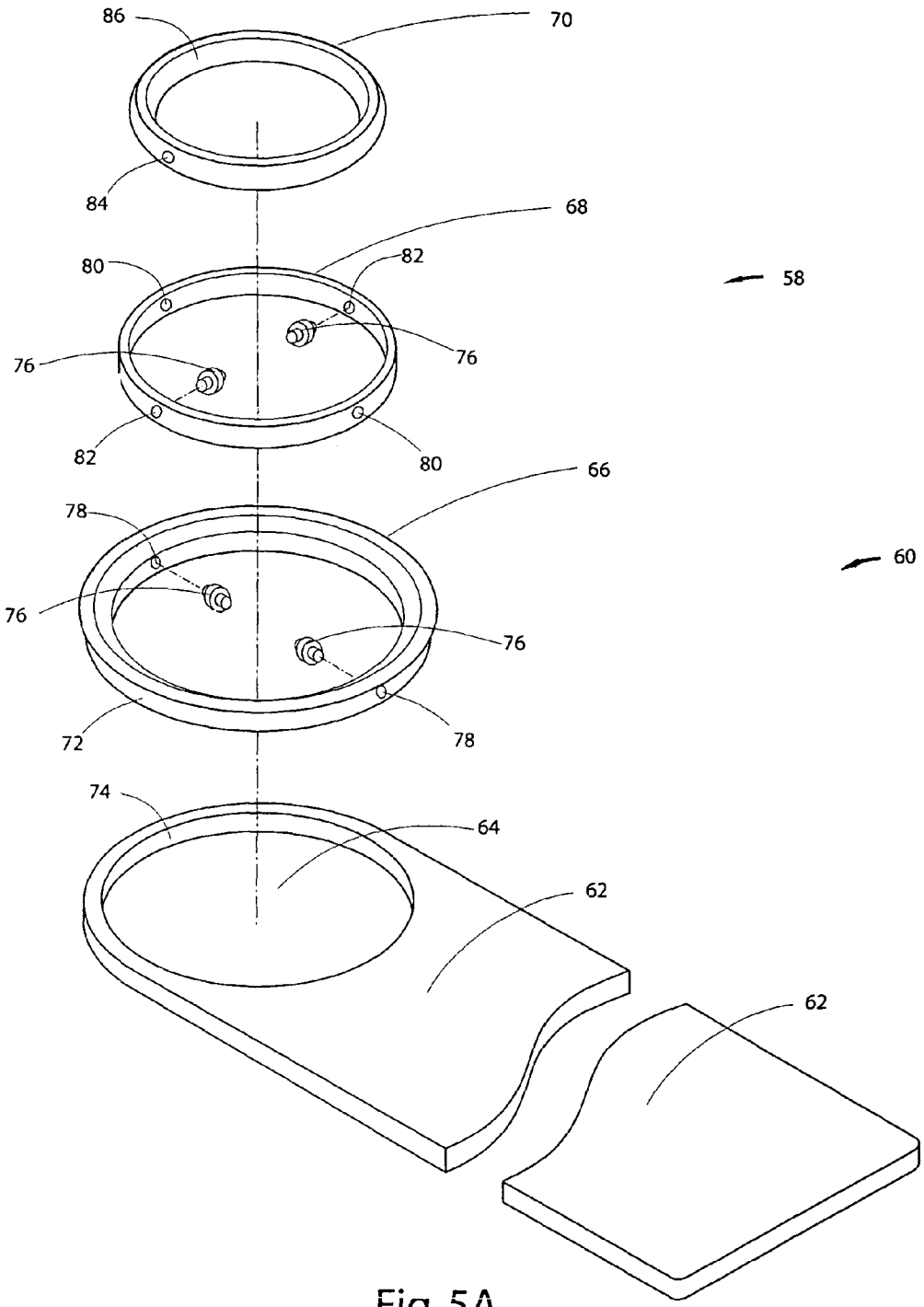
FIGS. 5A to 5C show different views of a support system (having a gimbal) constructed in accordance with the teachings of the present invention.
Figure 5B:
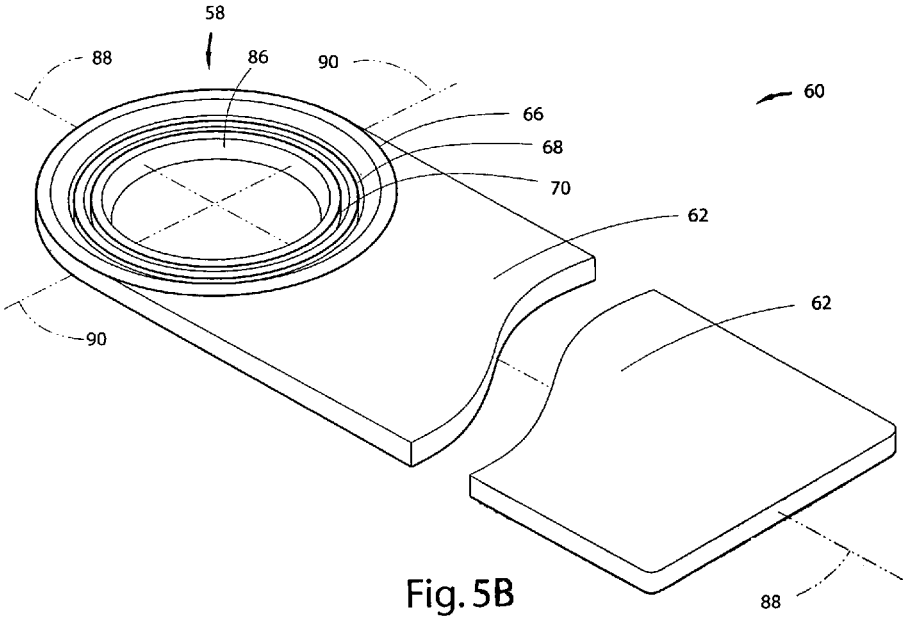
Figure 5C:
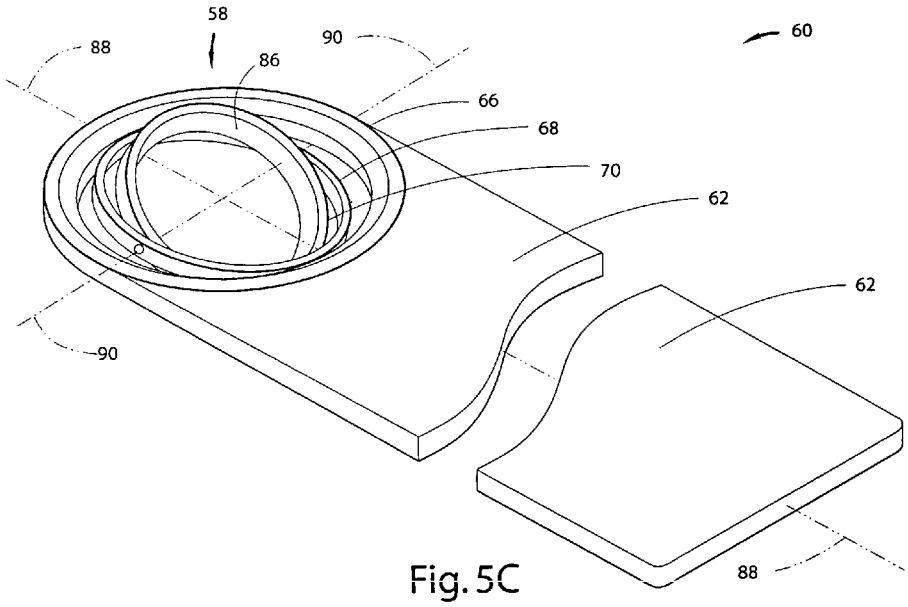

First end 14 of body 12 is shaped so that it can comfortably rest against the sternum of a person playing instrument 10; second end 16 of body 12 is tapered so that it can interface with a support (shown in detail in FIGS. 5A to 5C).

Figure 2A:
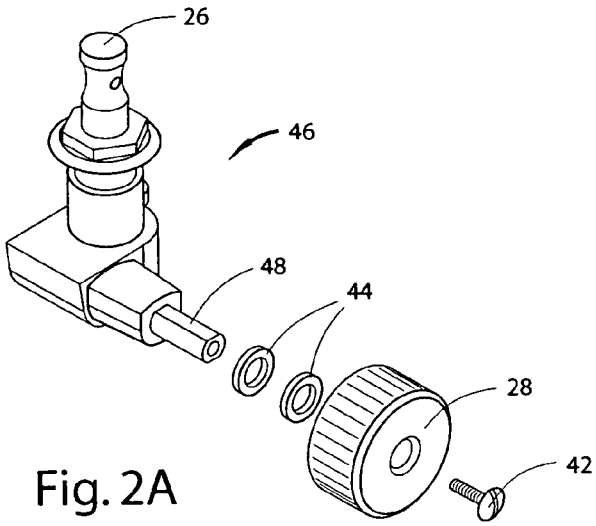
FIGS. 2A and 2B show two views of a machine tuner used with the instrument of FIG. 1A.
Figure 2B:
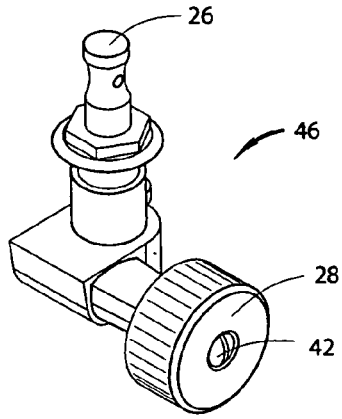
Figure 3:
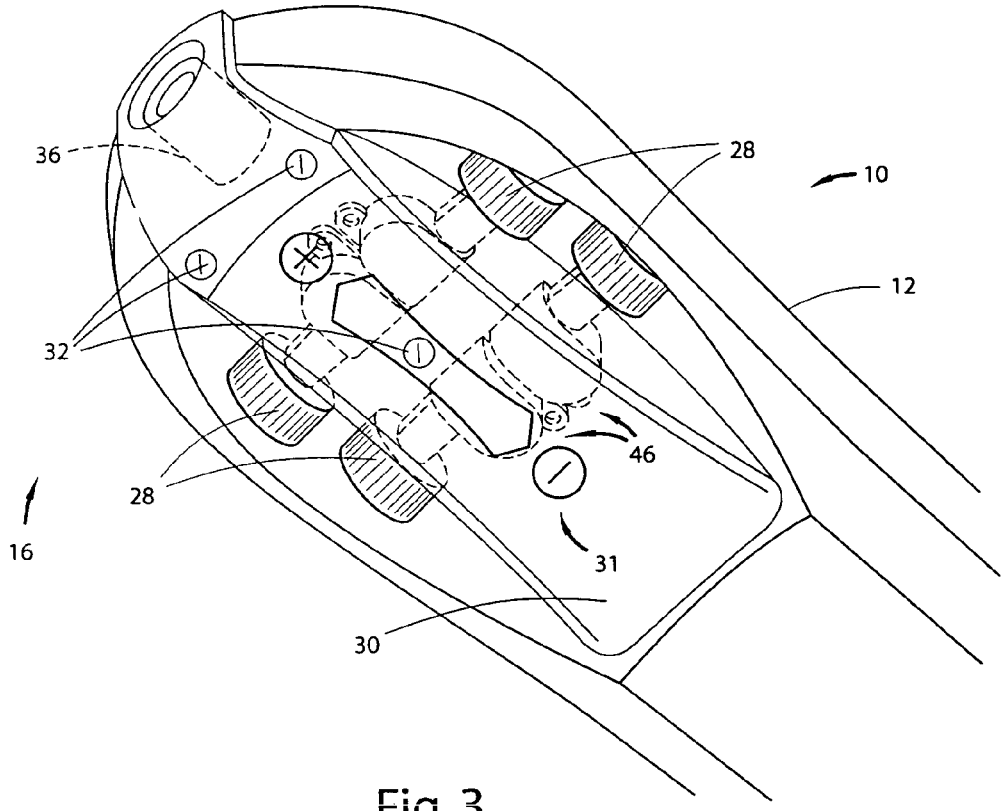
FIG. 3 shows the position of the tuners (of the type shown in FIG. 2A) within the assembly of the instrument of FIG. 1C.

FIGS. 2A (exploded perspective view), 2B (perspective view), and FIG. 3 (partial perspective view) show the structure of a machine tuner 46, including tuning peg 26 and tuning knob 28, used with instrument 10. The original tuning knob (not shown, part of a machine tuner available from Schaller, Germany) is replaced with tuning knob 28, shaped like a wheel and provided with a knurled surface on outer rim to provide friction. Tuning knob 28 is mounted onto a drive shaft 48 using a screw 42 and washers 44.

FIG. 3 shows cover plate 30, screws 32, and jack 36 (in dashed lines), as well as the integration of tuners 46 (shown partially in dashed lines; for clarity, number not shown) within body 12 of instrument 10. While tuning knobs 28 are retracted far enough into body 12 to avoid accidental tuning, a portion of each knob 28 is easily accessible to a person playing instrument 10; a string 18 can thus be tuned by sliding a finger tangentially along the outer rim of corresponding tuning knob 28 parallel to the longitudinal axis (not numbered here) of instrument 10. For clarity, cable 34 is not shown. Visual guide 31 indicates the relationship between sliding direction and pitch direction.

Figure 4A:
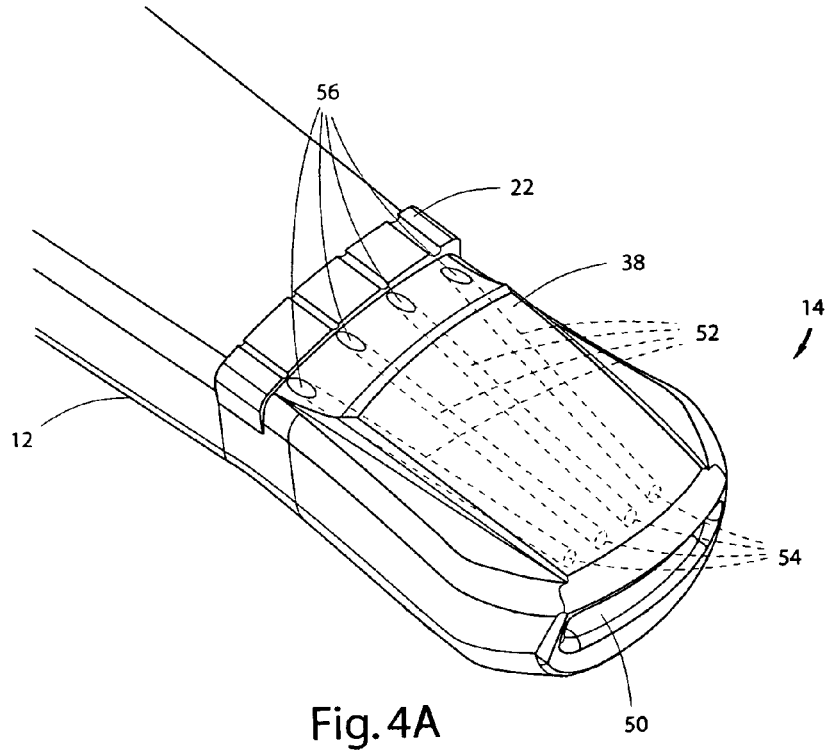
FIGS. 4A and 4B show two partial views detailing the top part of the instrument of FIG. 1A.
Figure 4B:
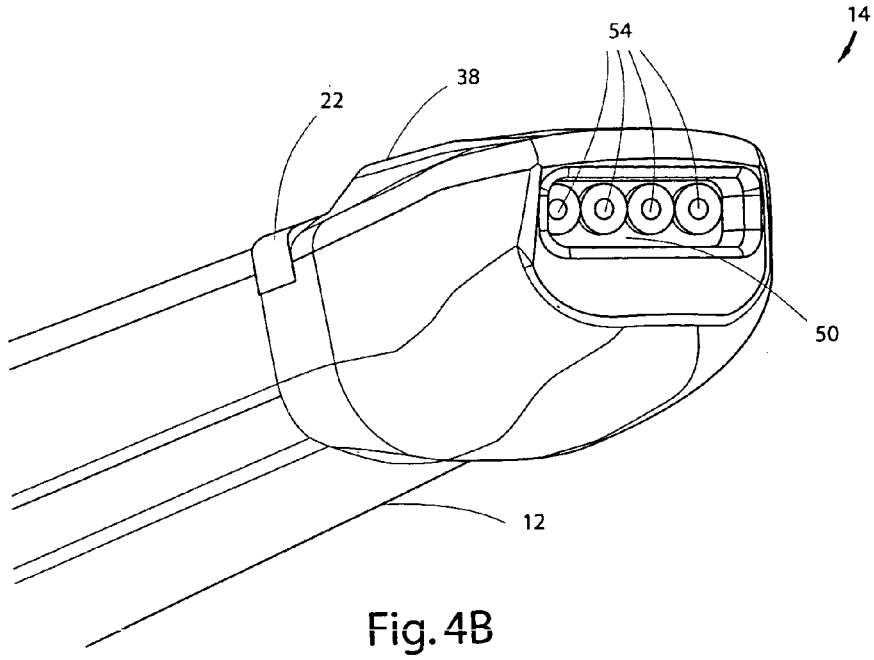

FIGS. 4A and 4B (both perspective partial views) show the front and back side of first end 14 of body 12 of instrument 10 in more detail. Strings 18 (here not shown for clarity) are anchored in a retracted area, cavity 50, each passing through a corresponding tunnel 52 (shown in dashed lines under protrusion 38) that extends from a tunnel entrance 54 inside cavity 50 to a tunnel exit 56 close to nut 22. Tunnel entrances 54 are fitted with replaceable washers (not numbered) to prevent strings 18 from damaging body 12 of instrument 10.

The entire first end 14 of body 12 is designed to enable an ergonomic interface between instrument 10 and a person playing instrument 10, specifically between first end 14 and the sternum of the person: the surface surrounding first end 14, especially the back side and area framing cavity 50, is smooth and rounded; and strings 18 are retracted within cavity 50 far enough to prevent any interference with the interface between instrument 10 and the person playing instrument 10.

FIGS. 5A (exploded perspective view), 5B (assembled perspective view), and 5C (perspective view) show a preferred embodiment of a support 60 for use with instrument 10, support 60 comprising a support member 62 and a gimbal system 58 which comprises an outer ring 66, median ring 68, and inner ring 70 (the word "gimbal" is often used to refer to a single ring as well as to the assembly of two or more rings; to avoid confusion the word "gimbal" is used only in connection with the term "gimbal system", referring to a set of pivotally interacting rings). Support member 62 has a hole 64 at one end, shaped slightly elliptic for receiving gimbal system 58 (FIG. 5A). The outer ring 66 of gimbal system 58, while having both a round upper rim and round inner surface shape, has a slightly elliptic periphery 72 corresponding to the inner surface shape 74 of hole 64. Thus, outer ring 66 is a stationary ring; it connects gimbal system 58 with support member 62. Basing the interface between gimbal system 58 and support member 62 on an elliptic (not round) shape in effect clearly defines such interface (the symmetry of gimbal system 58 allows two possible ways of interfacing, both indistinguishable).

Median ring 68 of gimbal system 58 is connected at bores 80 to outer ring 66 at bores 78 by pins 76; bores 78 thus define a pivot axis 88 (FIGS. 5B and 5C) for the rotation of median ring 68 relative to outer ring 66. Pivot axis 88, by design, is identical to the longitudinal axis (referred to with same number to avoid confusion) of support member 62.

Inner ring 70 of gimbal system 58 is connected at bores 84 (only one bore visible) to median ring 68 at bores 82 by pins 76; bores 82 thus define a pivot axis 90 (FIGS. 5B and 5C) for the rotation of inner ring 70 relative to median ring 68. The inner surface shape 86 of inner ring 70 (here shown slightly conical) is designed to correspond to the shape of second end 16 (not shown) of body 12 of instrument 10 (not shown). The inner ring 70 can be fitted with a rubber grommet (option not shown) to improve the interface between instrument 10 and support 60.

FIG. 5B shows support 60 with gimbal system 58 having both median ring 68 and inner ring 70 positioned within the plane of support 60, thereby enabling convenient storage and transportation.

FIG. 5C shows support 60 with gimbal system 58, median ring 68 and inner ring 70 in a position different from that shown in FIG. 5B. While inner ring 70 has two degrees of freedom (pivot axes 88 and 90; orientation of axis 90 dependent on rotation around axis 88) it can not rotate within its own plane.

Operation

Figure 6:
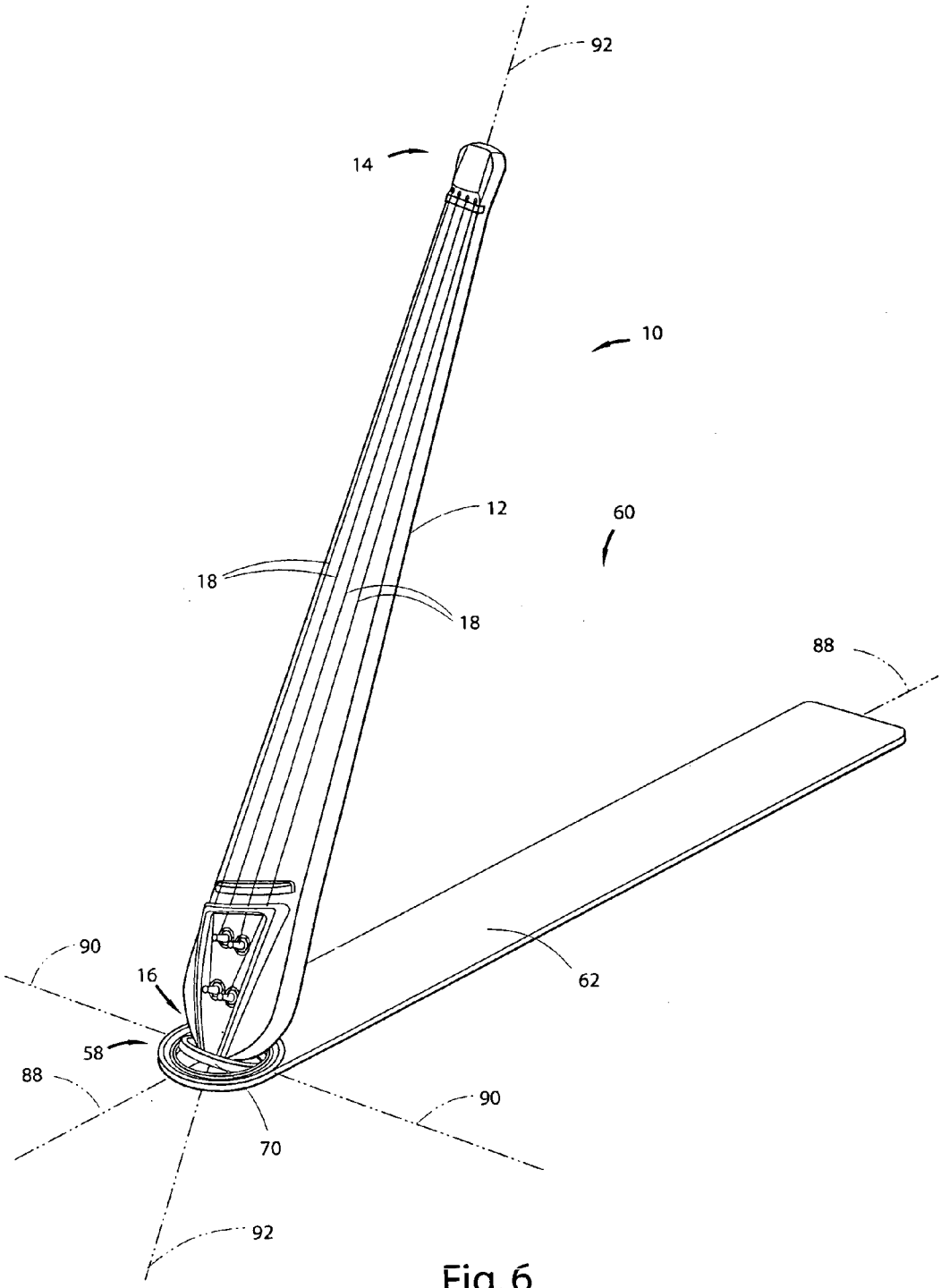
FIG. 6 shows the musical instrument of FIG. 1A interfacing with the support of FIG. 5B.

FIG. 6 (perspective view) shows instrument 10 and support 60, second end 16 of body 12 of instrument 10 interfacing with gimbal system 58 of support 60, specifically at inner ring 70. There is a special degree of freedom regarding the interface between instrument 10 and support member 62 (stationary portion of support 60): the orientation of instrument 10—relative to its longitudinal axis 92—is not defined prior to interfacing with support 60, thereby enabling a musician to arrange his/her interface to personal preferences. Instrument 10 is retaining its position relative to inner ring 70 (of gimbal system 58) due to (gravity-induced) friction between inner surface shape 86 (FIGS. 5A to 5C) of inner ring 70 and second end 16 of body 12. Thus, the degrees of freedom of instrument 10 relative to support member 62 are defined by the degrees of freedom of inner ring 70 relative to support 60 as described in FIGS. 5A to 5C.

Figure 8:
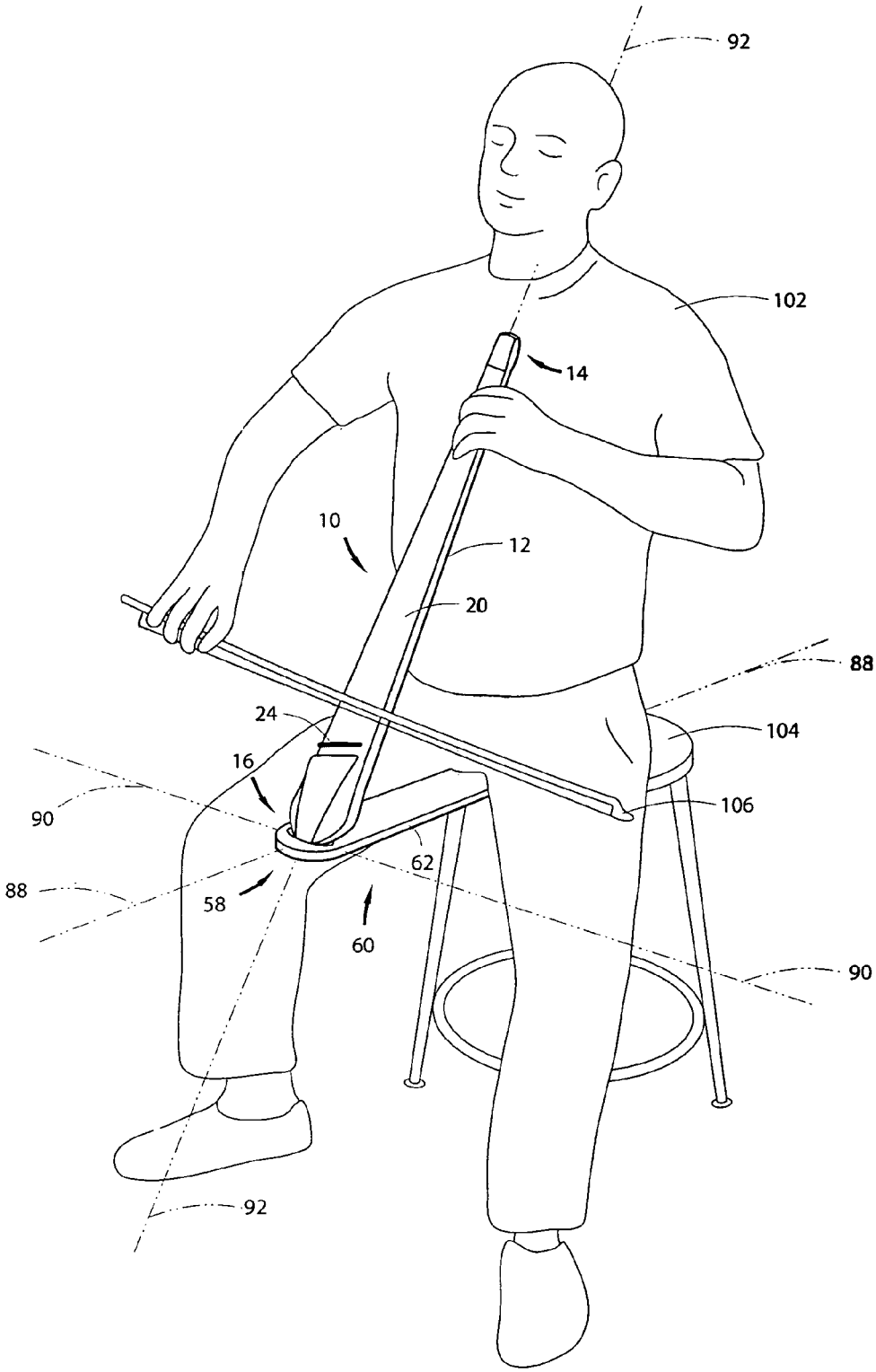
FIG. 8 shows the instrument of FIG. 1A being played by a musician.

Rotation of instrument 10 around its longitudinal axis 92 is resisted, as long as axis 92 is not aligned with axis 88 (axes 92 and 88 identical); axis 92 is stabilized at first end 14 (interface with torso of a musician as shown in FIG. 8) and second end 16 (interface with inner ring 70), second end 16 stable due to its very location (by design of instrument 10) on said axis 88. This described rotational stability is little effected by forces (plucking or bowing) applied to strings 18, because strings 18 (by design of instrument 10) are relatively close to the longitudinal axis 92 of instrument 10.

Figure 7:
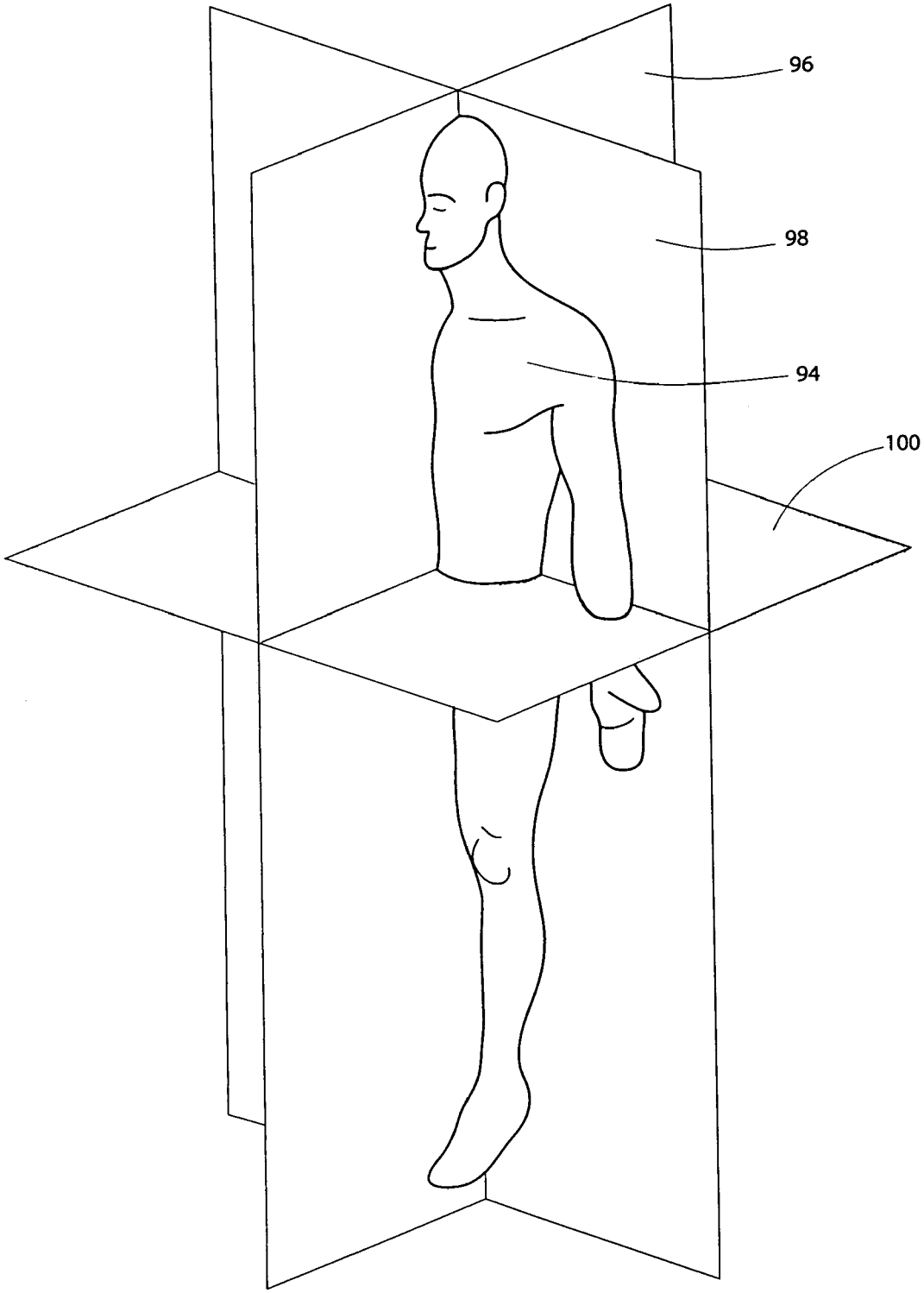
FIG. 7 illustrates the anatomical planes of a human body.

FIG. 7 (perspective view) shows three imaginary planes that pass through the human body 94 in the anatomical position, which help to describe movements and body positions. These are the median plane 96, coronal plane 98, and horizontal plane 100.

Median plane 96 is an imaginary vertical plane that passes through the middle of body 94, dividing it into left and right halves. A sagittal plane is a vertical plane which runs parallel to median plane 96, but does not necessarily pass through the body's midline. Thus, median plane 96 is a specific type of sagittal plane. Coronal plane 98 is a vertical plane which is perpendicular to the median and sagittal planes, and is sometimes also referred to as the frontal plane. Horizontal plane 100, or transverse plane, is a plane which splits the body into upper and lower halves.

It will be understood by those skilled in the art who have the benefit of this disclosure that the anatomical planes described herein are being defined relative to the torso of the human body 94; in other words, the orientation of the anatomical planes is congruent with the orientation of the torso of the human body 94.

FIG. 8 (perspective view) shows a musician 102 playing instrument 10, instrument 10 interfacing at first end 14 with musician 102 at the sternum and at second end 16 with support 60 via gimbal system 58. Support member 62 of support 60 is connected to the seat of a chair 104. While support member 62 can be secured at chair 104 by a clamp (not shown) or other means, it can be held in place by musician 102 sitting on chair 104. Support member 62 is thus stationary relative to chair 104.

Support 60 is positioned having pivot axis 88 of median ring 68 (pivot axis 88 identical to longitudinal axis of support member 62) positioned on the median plane of musician 102. The interface between instrument 10 and support 60 is thereby positioned on the median plane of musician 102; the interface between instrument 10 and musician 102 (at the sternum, located by definition on the median plane) is positioned on the median plane. Thus, instrument 10, specifically longitudinal axis 92 of body 12 of instrument 10, is now positioned on the median plane of musician 102.

The position of support 60 relative to musician 102, specifically the distance between gimbal system 58 and the seat of musician 102, defines the position of instrument 10 relative to musician 102, specifically the orientation of longitudinal axis 92 of instrument 10 and the precise location of the interface between first end 14 and musician 102 at the sternum. Pivot axis 90 facilitates the adjustment of the angle between longitudinal axis 92 of instrument 10 and longitudinal axis 88 of support member 62. Musician 102 can thus adjust the position of instrument 10 by adjusting the position of support 60.

The symmetry of human body 94 (FIG. 7) relative to median plane 96 (FIG. 7) defines basic principles for ergonomic posture. The basic playing position of instrument 10 on the median plane of musician 102 enables such ergonomic posture, facilitating a natural position of the spine as well as near neutral positioning of wrist, hand and shoulder. Especially the left arm of musician 102 can operate in a natural position in front of the torso of musician 102 further preventing the left shoulder from operating in its end-range of rotation. The streamlined structure of body 12 of instrument 10, especially the omission of additional body outlines imitating the structure of an acoustic instrument, enables the left hand of musician 102 to comfortably access the entire fingerboard 20.

The described position of instrument 10 further facilitates ergonomic string crossings that can now be executed by rotating the entire arm-torso-system of musician 102 around an axis (ideally being the longitudinal axis of fingerboard 20, close to longitudinal axis 92 of instrument 10) located on the median plane of musician 102.

Instrument 10, when interfacing with support 60, resists rotation around its longitudinal axis 92; thus, it does not require musician 102 to stabilize instrument 10 by using legs or even the left hand, eliminating restrictions of the musician's mobility. In fact, instrument 10, when interfacing with support 60, interfaces with musician 102 at only one point, enabling maximum freedom of motion; further, this interface at the sternum of musician 102 is very comfortable, due to both the shape of first end 14 of body 12 and the low effective pressure applied to the sternum. The sternum is chosen as the point of interface between musician 102 and instrument 10 for several reasons: the sternum is located (by definition) on the median plane, enabling a position of instrument 10 that facilitates the discussed ergonomic advantages; the sternum, not covered by thick tissue, provides a firm base for a stable interface; and the sternum further provides reasonable stationary stability, little effected by any movement of the arms of musician 102.

Unrestricted freedom of motion is certainly essential for proper playing technique, especially side-to-side swaying motion. When seated, this side-to-side motion is confined to the torso of musician 102, the idealized pivot axis for this swaying motion of the torso being close to longitudinal axis 88 (identical to pivot axis of median ring 68) of support member 62, axis 88 located on the median plane of musician 102 and perpendicular to the coronal plane of musician 102. Thus, gimbal system 58, in particular pivot axis 88 of median ring 68, enables instrument 10 to move congruently with the torso of musician 102, when swaying side-to-side; instrument 10 retains its position relative to the torso of musician 102 (longitudinal axis of instrument 10 on the median plane of musician 102) when said torso sways side-to-side. Clearly, the configuration of gimbal system 58 (axes perpendicular, axis 90 dependant on axis 88) as well as its orientation, relative to the anatomical planes of musician 102, is essential to the described operation; thus, a ball bearing pivoting system does not constitute a useful alternative.

While the position of pivot axis 88 is essential for instrument 10 to move congruently with the torso of musician 102, there are alternatives to support 60 (chair-based) including gimbal system 58 (freedom of motion defined by two perpendicular pivot axes); a tripod (floor-based) having a universal joint (two perpendicular pivot axes) would be such an alternative. However, a chair-based support such as support 60 has several advantages: by definition, support 60 provides stationary stability relative to chair 104, thereby securing the position of the interface (between instrument 10 and support 60) relative to musician 102 sitting on chair 104; support 60 further provides convenience when used with a height-adjustable seat, again retaining the position of said interface (between instrument 10 and support 60) relative to musician 102; and support 60 facilitates the use of a swivel chair, an option that is not practical when using an endpin-support (floor-based) cello.

The affinity in size and shape between instrument 10, support 60, and bow 106 allows for easy storage and transportation.

The length of body 12 and the position of both nut 22 at first end 14 and bridge 24 at second end 16 enable an ergonomic playing posture and playing technique for both left hand and right arm operations. The effective string length, defined as distance between nut 22 and bridge 24, is larger than that of a traditional viola and smaller than that of a traditional cello.

Figure 9A:
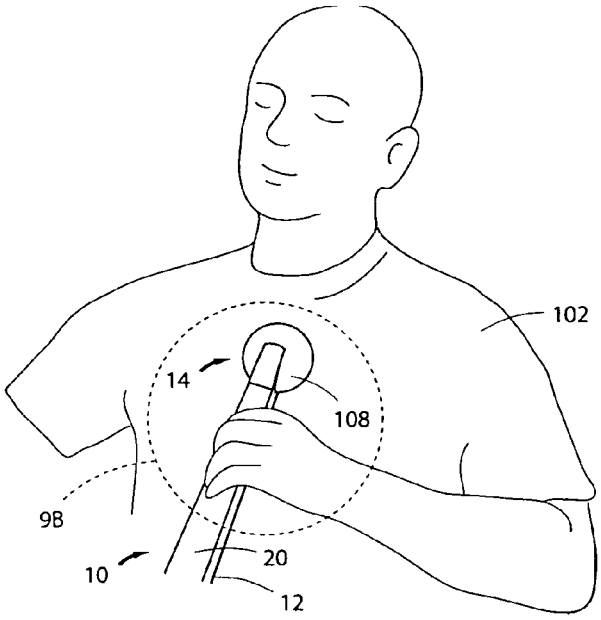
FIGS. 9A and 9B show two views of an attachment used with the instrument of FIG. 1A.
Figure 9B:
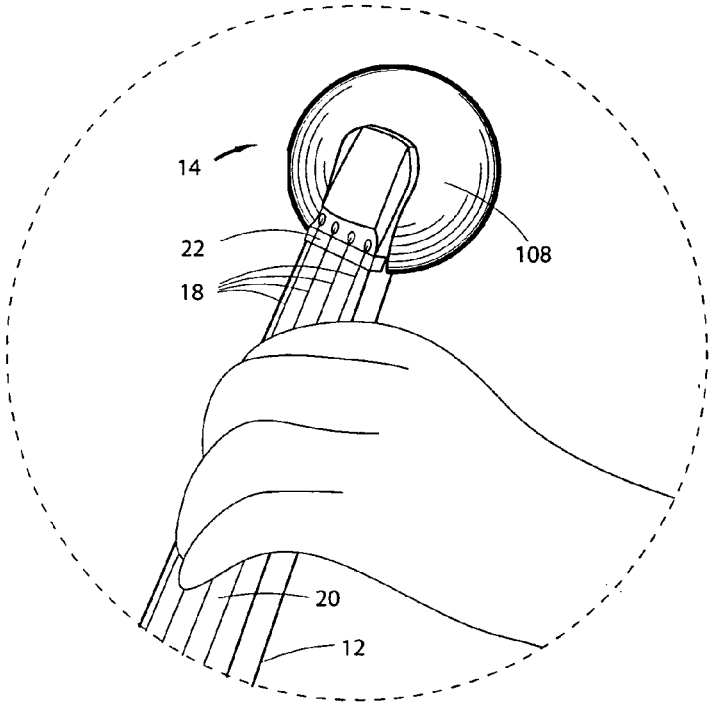

FIGS. 9A (perspective view) and 9B (enlarged view) show a preferred embodiment of an optional attachment 108 for use with the first end 14 of body 12 of instrument 10. Attachment 108 has the structure of a ball having a cut-out, shaped to complement the shape of first end 14; attachment 108 connects to the back side of first end 14 by friction fit.

Attachment 108 adds several features to the functionality of the interface between musician 102 and instrument 10: attachment 108 provides a wider surface area for comfortably contacting with the sternum of musician 102; attachment 108 increases the distance between instrument 10 and the sternum of musician 102, changing the position of the interface between the left hand of musician 102 and instrument 10 to a preferred position; attachment 108 covers cavity 50 (FIGS. 4A and 4B) at first end 14, preventing any interference of strings 18 (anchored within cavity 50) with fibers (entering cavity 50) of garment worn by musician 102; and attachment 108 further protects both instrument 10 (at first end 14 of body 12) and musician 102.

Attachment 108 can be supplied in different sizes accommodating the personal preferences of a person playing instrument 10.

Figure 10:
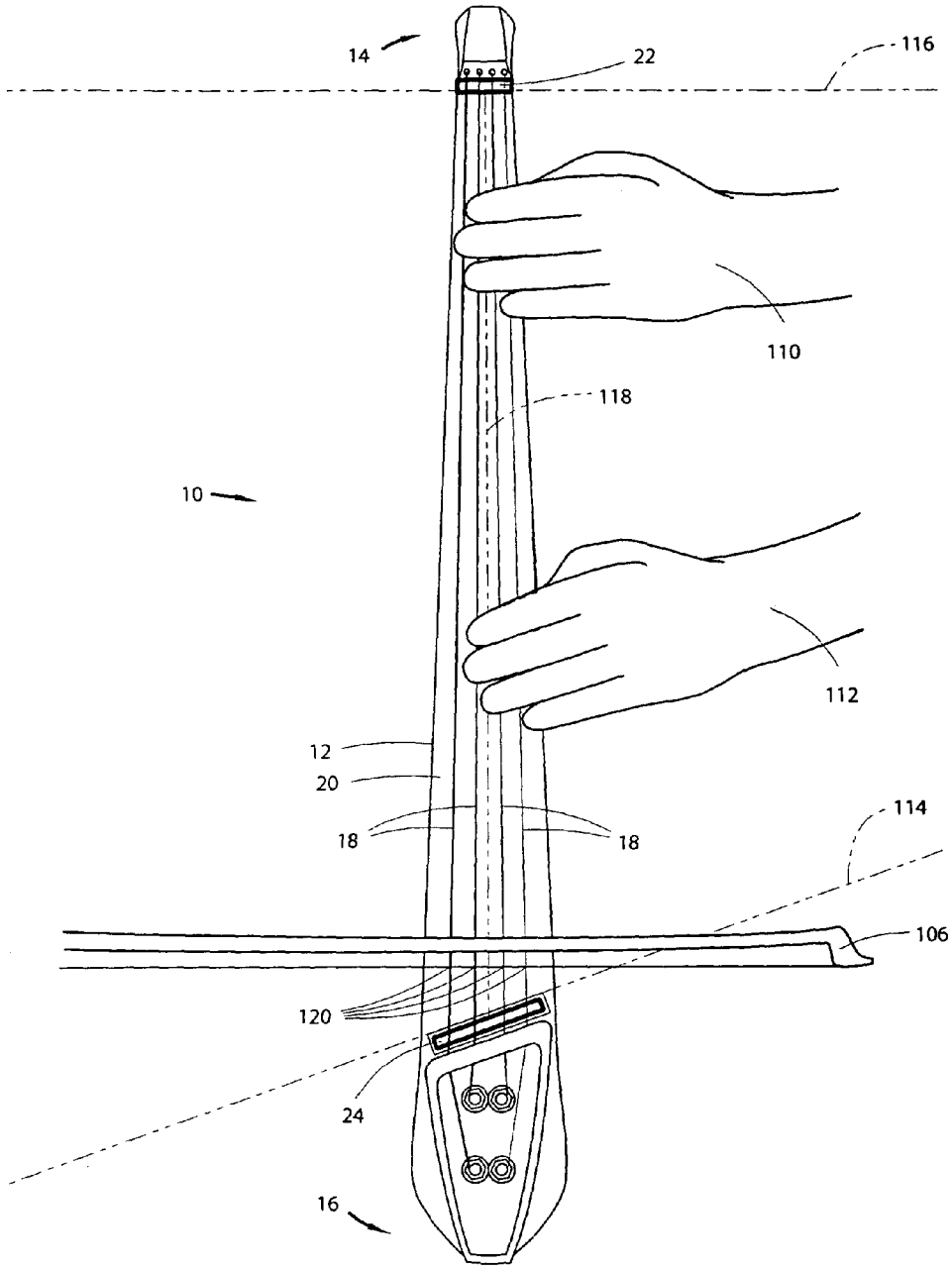
FIG. 10 illustrates the interface between the musician's left hand and the instrument of FIG. 1A, as well as the interface between a bow and the instrument.

FIG. 10 (front elevational view) shows instrument 10, including strings 18 suspended over fingerboard 20 between nut 22 and bridge 24.

Figure 12A:
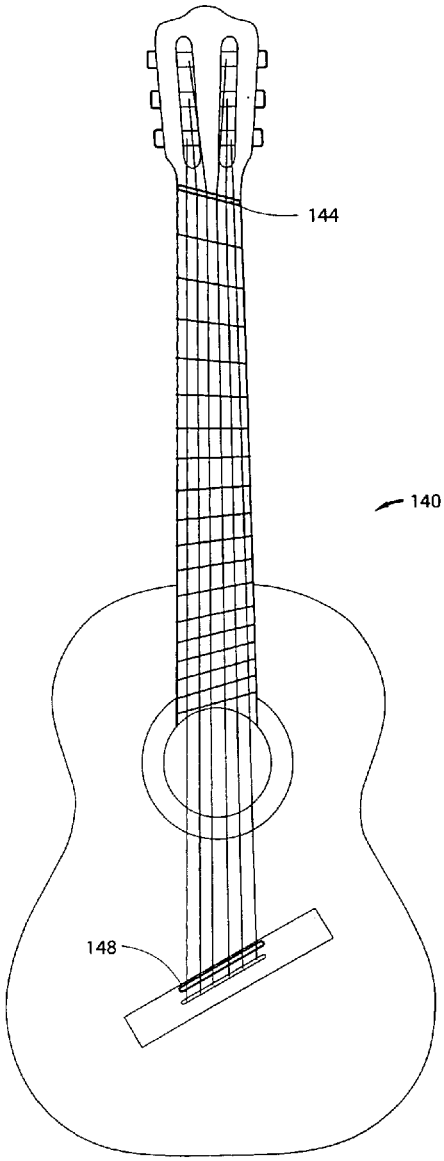
FIGS. 12A and 12B show two embodiments of a guitar.
Figure 12B:
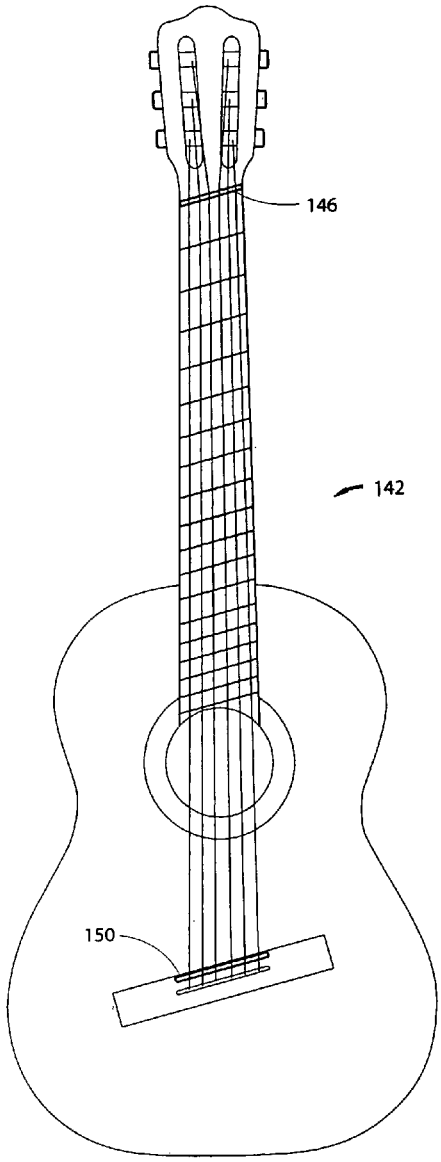

The orientation 114 of bridge 24, not being perpendicular to longitudinal axis 118 of fingerboard 20, creates a non-traditional fingerboard topology (imaginary grid of strings 18 and fret system, projected onto fingerboard 20, as shown in FIGS. 12A and 12B). This fingerboard topology is ergonomically aligned to agree with the natural orientation of the left hand of musician 102 (FIG. 8): the orientation 116 of nut 22 (perpendicular to longitudinal axis 118 of fingerboard 20) matches the orientation of the musician's hand 110, as hand 110 approaches nut 22; the orientation 114 of bridge 24 matches the orientation of the musician's hand 112, as hand 112 approaches bridge 24. This fingerboard topology consequently enables ergonomic string crossings for the left hand.

Further, the non-traditional orientation 114 of bridge 24 substantially aligns the points of contact 120 with the normal orientation of bow 106 (perpendicular to longitudinal axis 118 of fingerboard 20) facilitating more convenient string crossings for the bow arm.

String crossings for both the left arm and bow arm are hence improved elegantly by the non-traditional orientation 114 of bridge 24.

Alternative Embodiments

Figure 11A:
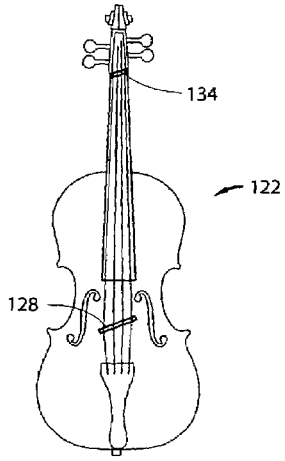
FIGS. 11A to 11C show members of the violin family.
Figure 11B:
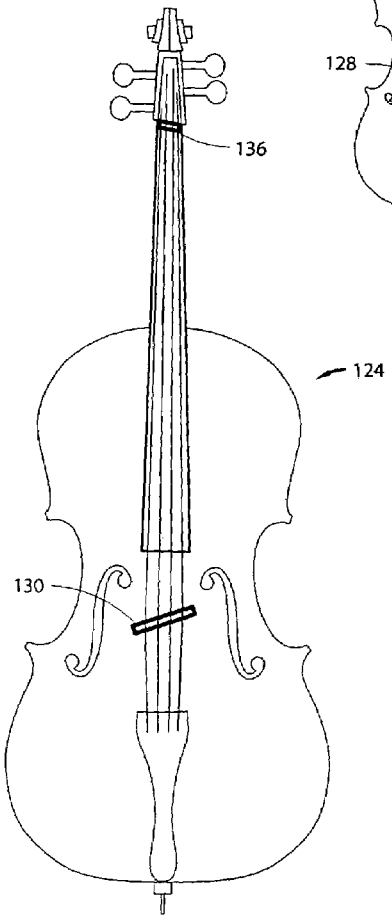
Figure 11C:
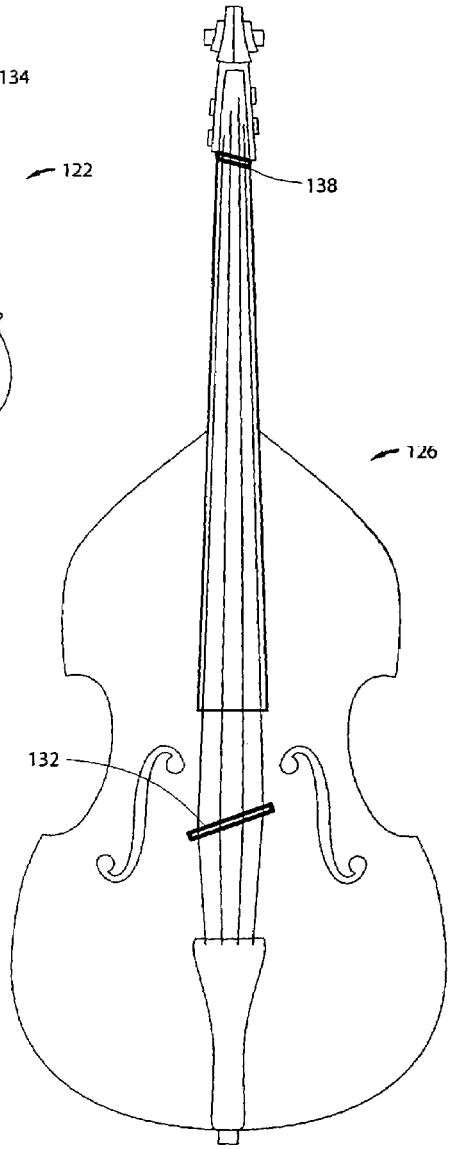

FIGS. 11A to 11C (front elevational view) show members of the violin family, in particular a violin (or viola) 122, a cello 124, and a double bass 126, all instruments having a non-traditional nut-bridge configuration for ergonomic fingerboard topology and substantial alignment of known points of contact with the orientation of a bow.

Violin 122 (FIG. 11A) shows the non-traditional orientation of the nut 134 substantially aligned with the non-traditional orientation of the bridge 128, reflecting the almost constant orientation of the left hand (of a violinist) throughout its entire range of motion. The non-traditional orientation of bridge 128 further provides substantial alignment of the points of contact with the orientation of the bow improving string crossings for the bow arm.

Cello 124 (FIG. 11B) shows a non-traditional orientation of the nut 136, reflecting the orientation of the left arm (of a cellist) when playing close to nut 136 (left hand higher than left elbow). The non-traditional orientation of bridge 130 reflects the orientation of the left arm (of a cellist) when playing close to bridge 130 (left hand lower than left elbow). The non-traditional orientation of bridge 130 further provides substantial alignment of the points of contact with the orientation of the bow improving string crossings for the bow arm.

Double bass 126 (FIG. 11*c*) shows a non-traditional orientation of the nut 138, reflecting the orientation of the left arm (of a bassist) when playing close to nut 138 (left hand higher than left elbow). The non-traditional orientation of bridge 132 reflects the orientation of the left arm (of a bassist) when playing close to bridge 132 (left hand lower than left elbow). The non-traditional orientation of bridge 132 further provides substantial alignment of the points of contact with the orientation of the bow improving string crossings for the bow arm.

FIGS. 12A and 12B (front elevational view) show two embodiments of a traditional guitar, each having a non-traditional nut-bridge configuration for ergonomic fingerboard topology (here visible by grid of strings and frets), aligned to agree with the natural orientation of the left hand (of a guitarist).

Guitar 140 (FIG. 12A) has a fingerboard topology designed for a classical playing position (fingerboard near vertical). The non-traditional orientation of the nut 144 reflects the orientation of the left arm (of a guitarist) when playing close to nut 144 (left hand higher than left elbow). The non-traditional orientation of the bridge 148 reflects the orientation of the left arm (of a guitarist) when playing close to bridge 148 (left hand lower than left elbow).

Guitar 142 (FIG. 12B) has a fingerboard topology designed for a non-classical playing position (fingerboard near horizontal). The non-traditional orientation of the nut 146 reflects the orientation of the left arm (of a guitarist) when playing close to nut 146 (left hand higher than left elbow). The non-traditional orientation of the bridge 150 reflects the orientation of the left arm (of a guitarist) when playing close to bridge 150 (left hand lower than left elbow).

Figure 13:
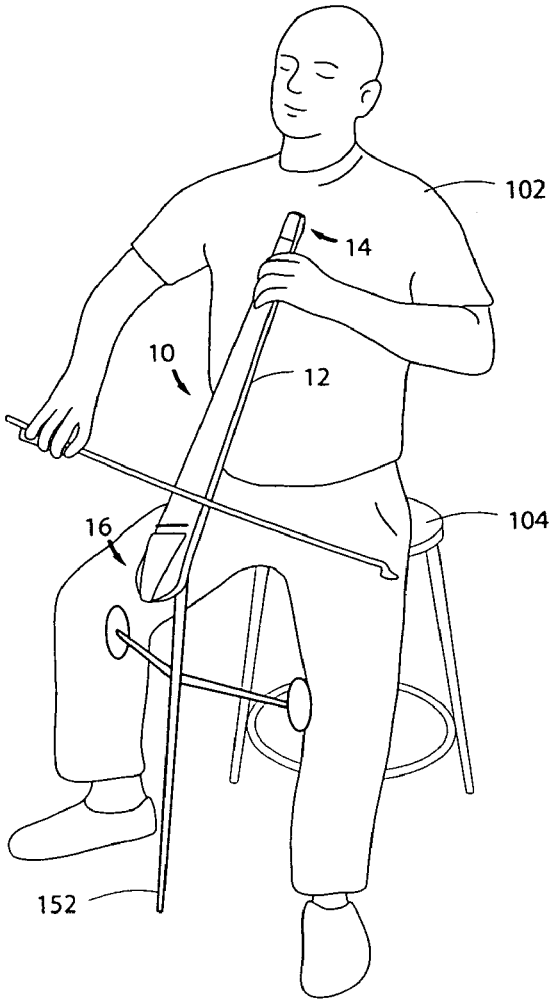
FIG. 13 shows a traditional support used with the instrument of FIG. 1A.

FIG. 13 (perspective view) shows body 12 of instrument 10 supported at second end 16 by a conventional endpin structure 152 positioned on the median plane of musician 102; first end 14 rests at the sternum (median plane) of musician 102. Instrument 10 is thus located on the median plane of musician 102, allowing a basic playing position with ergonomic advantages as described in detail in FIG. 8 and FIG. 10. However, the static (non-pivoting) interface between instrument 10 and endpin structure 152—facilitating only a floor-based pivot for instrument 10—prevents the described congruent movement of instrument 10 and the torso of musician 102 (FIG. 8). Further, said floor-based pivot (ball joint type) forces musician 102 to stabilize instrument 10, hence restricting the freedom of motion of musician 102.

Thus the combination of endpin structure 152 and instrument 10, utilizing only some of the claims of this invention, is not preferred.

Figure 14:
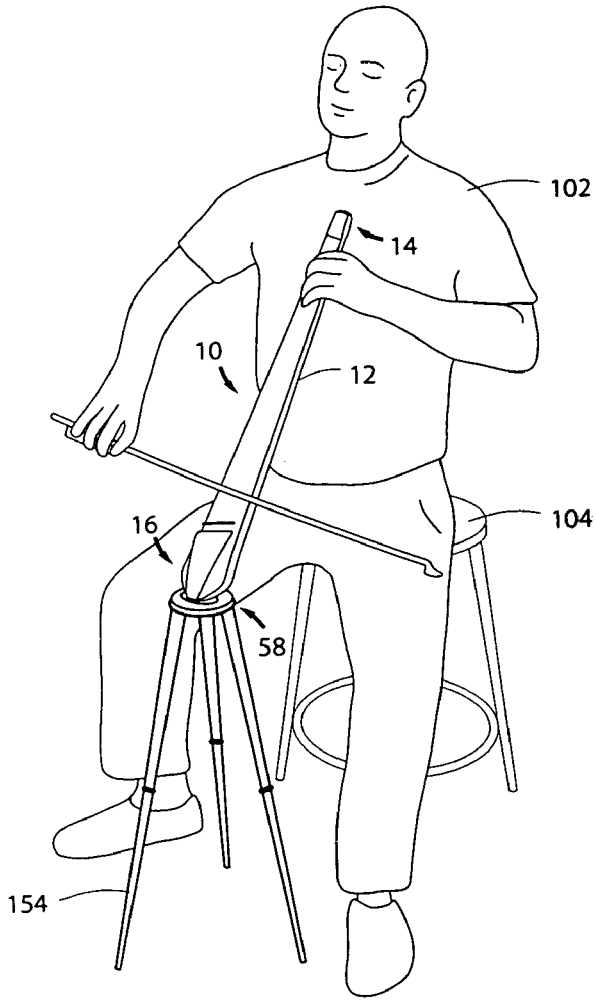
FIG. 14 shows an alternative embodiment of the support of FIG. 5A constructed in accordance with the teachings of the present invention.

FIG. 14 (perspective view) shows body 12 of instrument 10 supported at second end 16 by a tripod 154 (floor-based), tripod 154 including gimbal system 58 for interfacing with second end 16; first end 14 rests at the sternum (median plane) of musician 102. Tripod 154 enables gimbal system 58 to be positioned (relative to torso of musician 102) as described in FIG. 8. Although being a viable embodiment, the combination of tripod 154 and instrument 10 is not a preferred embodiment: tripod 154 is not linked structurally to chair 104; thus, precise adjustments are required to attain and maintain the relative position between tripod 154 and the seat of chair 104, further preventing the use of a swivel chair.

Figure 15:
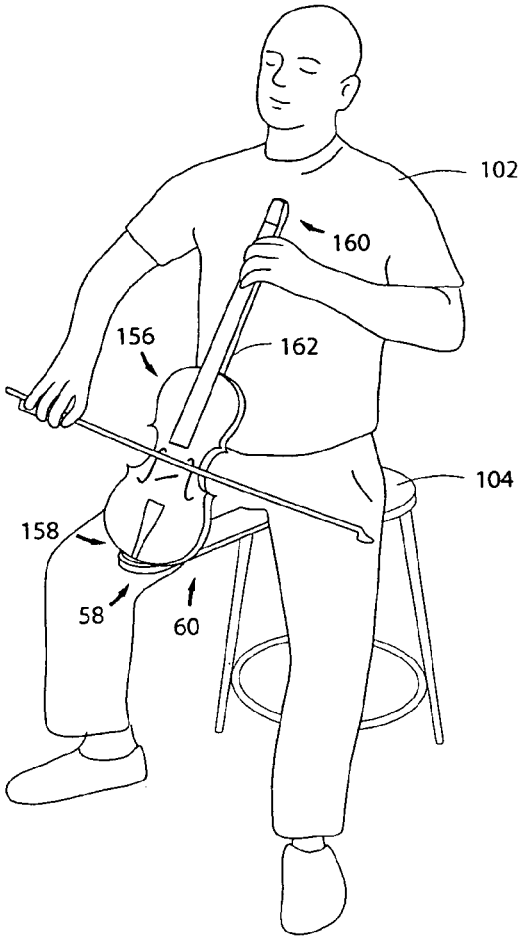
FIG. 15 shows an acoustic embodiment of the invention constructed in accordance with the teachings of the present invention.

FIG. 15 (perspective view) shows an acoustic embodiment 156 of instrument 10 used in combination with support 60. The first end 160 of the body 162 of acoustic embodiment 156 rests at the sternum of musician 102; the second end 158 of body 162 interfaces with support 60 at gimbal system 58. FIG. 15 thus shows a viable embodiment of this invention, offering the ergonomic benefits as described in FIG. 8 and FIG. 10.

Figure 16:
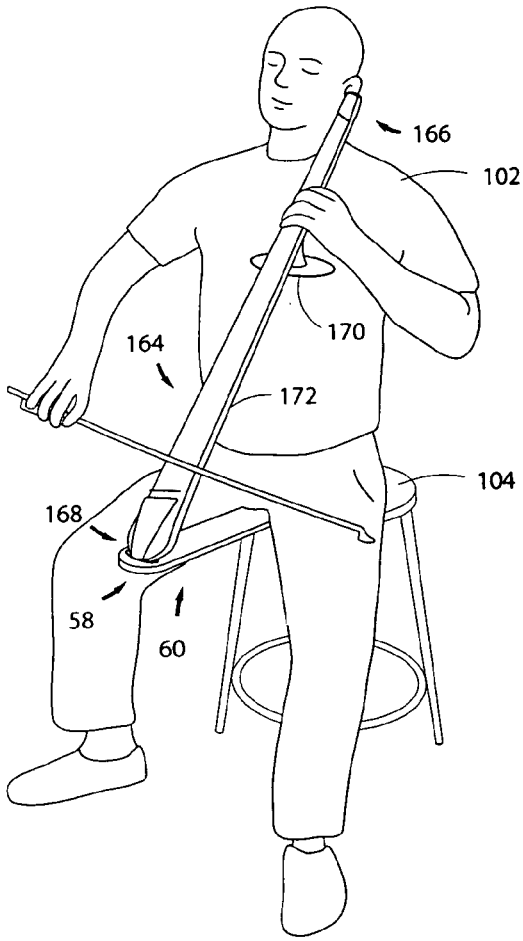
FIG. 16 shows a traditional electric cello used with the support of FIG. 5A.

FIG. 16 (perspective view) shows a conventional electric cello 164 (shown here with non-traditional nut-bridge configuration as described in FIG. 10) used in combination with support 60. A second end 168 of the body 172 of electric cello 164 interfaces with support 60 at gimbal system 58; body 172 is further supported at the sternum of musician 102 by a conventional chest support 170, a first end 166 of body 172 located above the shoulder of musician 102. While congruent movement between electric cello 164 and the torso of musician 102 is facilitated by support 60, body 172 of electric cello 164 can not be positioned on the median plane of musician 102.

Thus support 60 offers ergonomic benefits in playing a conventional electric cello such as electric cello 164.

Figure 17:
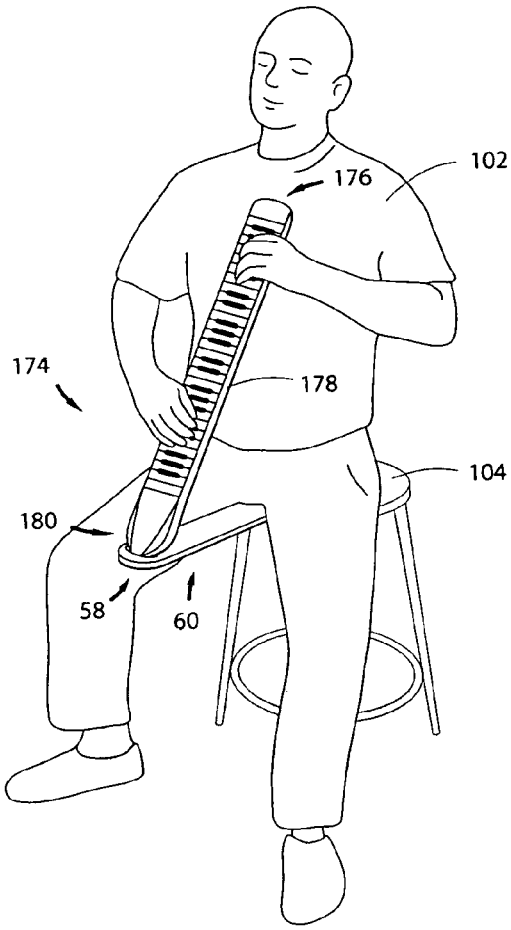
FIG. 17 shows a keyboard used with the support of FIG. 5A.

FIG. 17 (perspective view) shows a keyboard 174 used in combination with support 60. A first end 176 of the body 178 of keyboard 174 rests at the sternum of musician 102; a second end 180 of body 178 interfaces with support 60 at gimbal system 58. Keyboard 174 is positioned on the median plane of musician 102 and can thus move congruently with the torso of musician 102 via gimbal system 58 of support 60.

Thus the combination of keyboard 174 and support 60 offers many of the ergonomic benefits described in FIG. 8.

Figure 18:
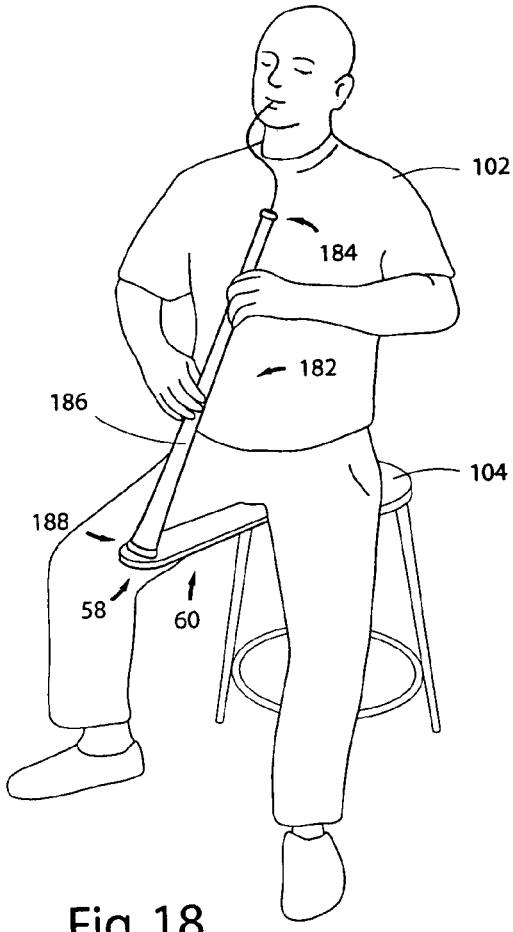
FIG. 18 shows a wind instrument used with the support of FIG. 5A.

FIG. 18 (perspective view) shows a wind instrument 182 used in combination with support 60. A first end 184 of the body 186 of wind instrument 182 rests at the sternum of musician 102; a second end 188 of body 186 interfaces with support 60 at gimbal system 58. Wind instrument 182 is positioned on the median plane of musician 102 and can thus move congruently with the torso of musician 102 via gimbal system 58 of support 60.

Thus the combination of wind instrument 182 and support 60 offers many of the ergonomic benefits described in FIG. 8.

Figure 19:
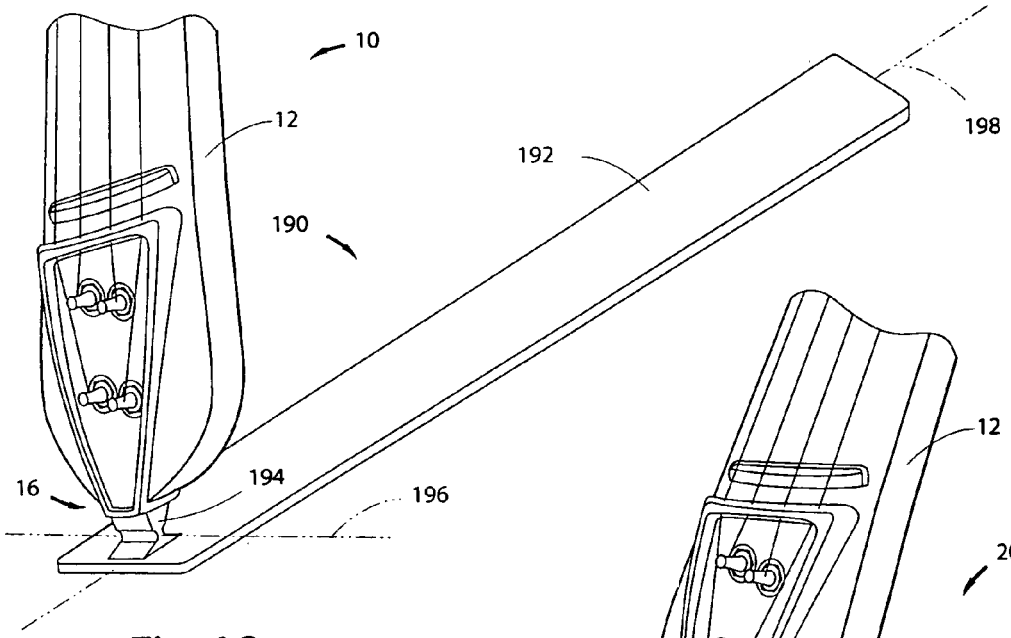
FIGS. 19 to 21 show the instrument of FIG. 1A used with alternative embodiments of the support of FIG. 5A.

FIG. 19 (perspective view) shows instrument 10 used with a first alternative support 190 having a support member 192 of a torsion-bar design. Support 190 includes a living hinge 194 interfacing with second end 16 of body 12 of instrument 10. Living hinge 194 enables rotation of body 12 around a first axis 196 defined by living hinge 194. Support member 192, being of a torsion-bar design, enables instrument 10 to rotate around a second axis 198 identical with the longitudinal axis of support member 192; support member 192 further enables spring-like reversion of instrument 10 to its original position.

Alternative support 190 thus provides a viable alternative to support 60 of FIG. 5A, adding the torsion-bar design's advantage of spring-like reversion of instrument 10 to its original position. Living hinge 194 provides a smooth rotation around axis 196.

Figure 20:
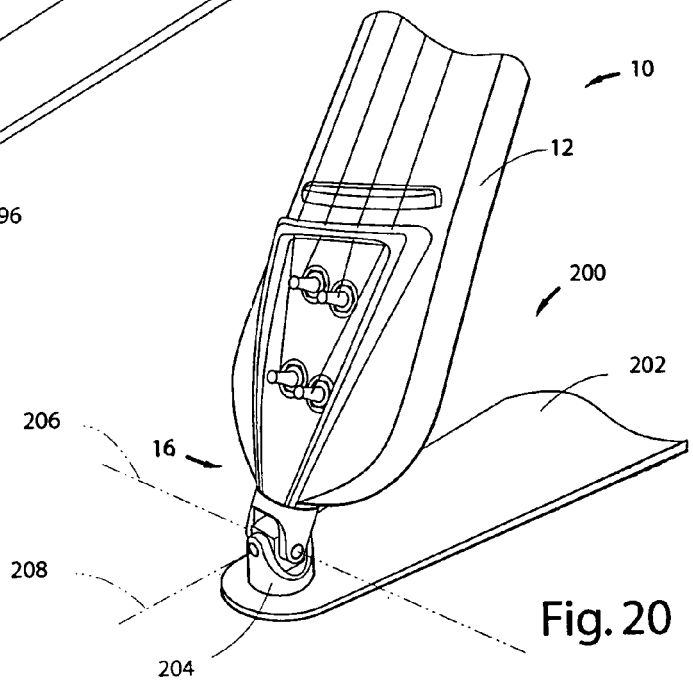

FIG. 20 (perspective view) shows instrument 10 used with a second alternative support 200 having a support member 202 and a universal joint 204 interfacing with second end 16 of body 12 of instrument 10. Universal joint 204 enables rotation of instrument 10 around two axes, first axis 206 and second axis 208, both axes perpendicular to each other, while preventing rotation of instrument 10 around its longitudinal axis 92 (not shown here). Thus second alternative support 200 provides a viable alternative to support 60 of FIG. 5A.

Figure 21:
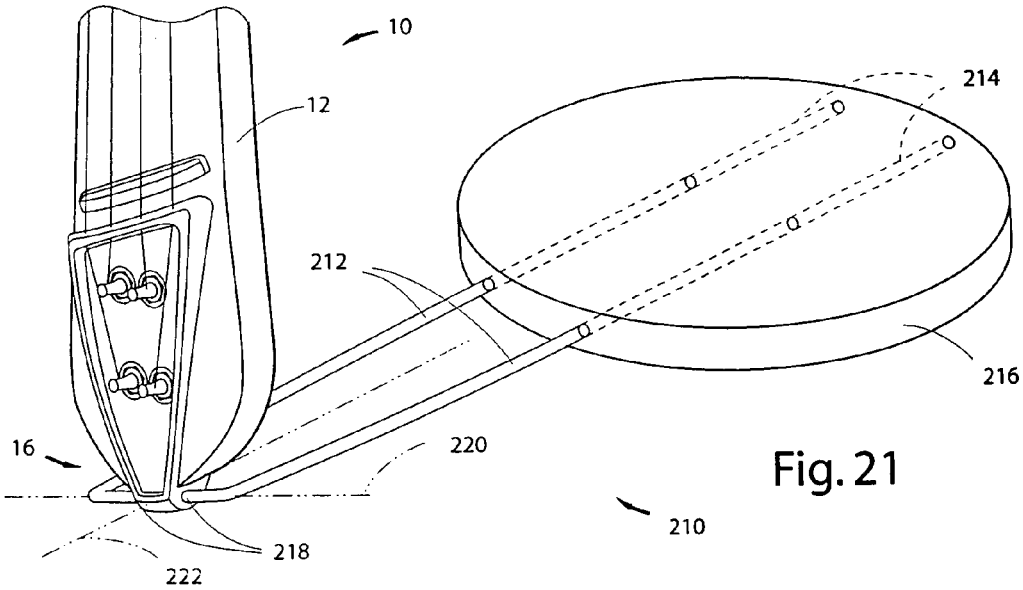

FIG. 21 (perspective view) shows instrument 10 used with a third alternative support 210 consisting of two support rods 212 (generally indicated) having two endpoints 218; rods 212 partially inserted into two corresponding bores 214 in a seat 216, the protrusion of rods 212 being adjustable. Rods 212 act as both pincers to grip second end 16 of body 12 and pivots, at endpoints 218, for rotation of instrument 10 around a first axis 220 defined by endpoints 218.

While rods 212 are stiff enough to support instrument 10, they allow bending sufficient to enable rotation of instrument 10 around a second axis 222 identical with the longitudinal axis of support 210.

Thus third alternative support 210 provides a viable alternative to support 60 of FIG. 5A.

Figure 22:
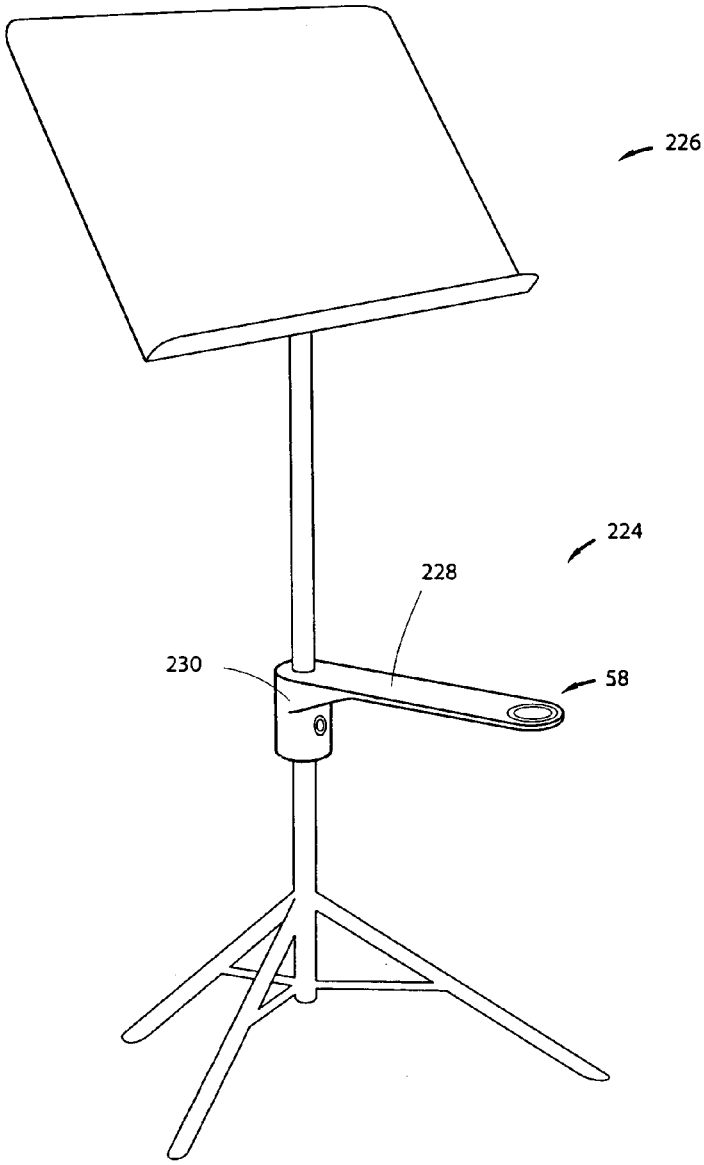
FIG. 22 shows an alternative embodiment of the support of FIG. 5A used with a traditional music stand.

FIG. 22 (perspective view) shows a fourth alternative support 224 used with a traditional music stand 226. Support 224 comprises a support member 228, a mounting system 230 for interfacing with stand 226, and gimbal system 58. While support 224 is height adjustable it is stationary relative to stand 226, and thus impractical for use with a swivel chair. A chair-based instrument support as shown in FIG. 5A is inherently more stable than support 224 used with stand 226, and thus fourth alternative support 224, although a viable alternative to support 60, is less desirable.

Figure 23:
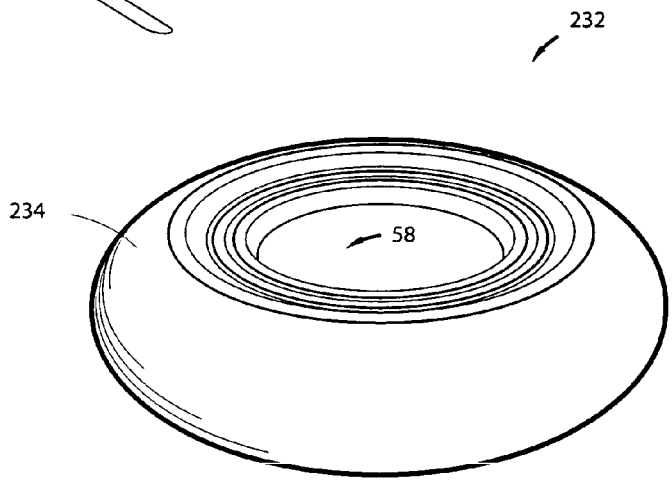
FIG. 23 shows an alternative, highly portable embodiment of the support of FIG. 5A.

FIG. 23 (perspective view) shows a highly portable fifth alternative support 232 that can be used with any flat surface. Support 232 comprises puck-like base 234 housing gimbal system 58, and thus offers all ergonomic benefits when having gimbal system 58 positioned relative to musician 102 (not shown here) as described in FIG. 8. Although highly portable and stable, fifth alternative support 232 is impractical for use with a swivel chair.

Figure 24:
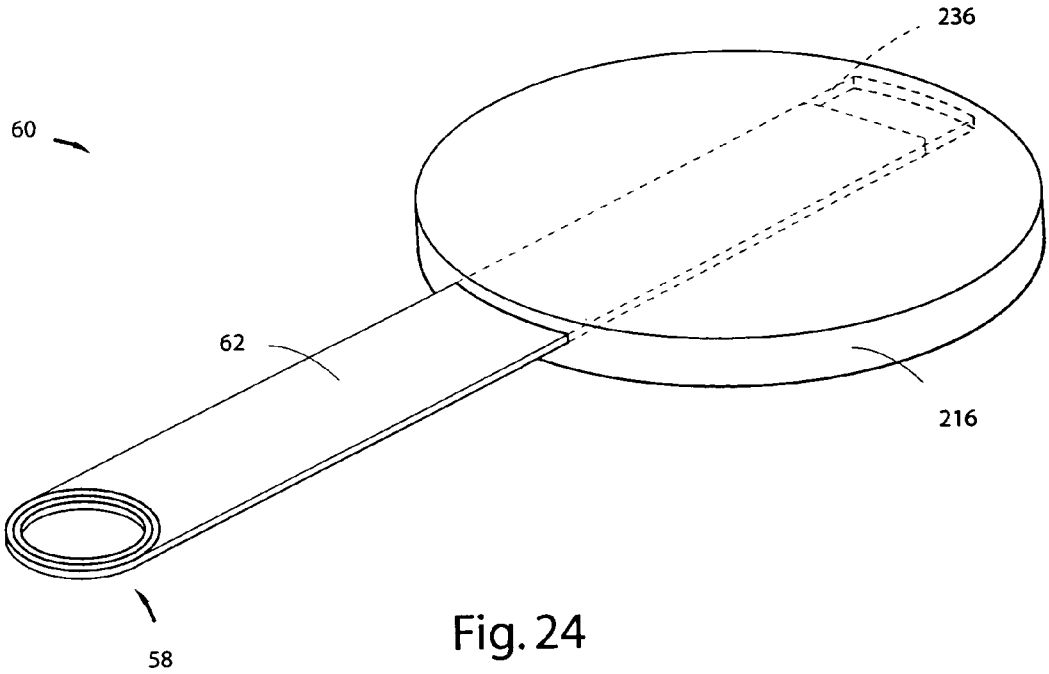
FIGS. 24 to 25 show the support of FIG. 5A used with the seat of a stool.

FIG. 24 (perspective view) shows an alternative way of interfacing support 60 with seat 216, having support member 62 inserted into a slot 236 in seat 216. While the protrusion of support 60 is adjustable, the interface between support 60 and seat 216 is secured by friction when support 60 interfaces with instrument 10 (not shown here). Thus the here described interface provides a more convenient alternative to having support member 62 supported on top of seat 216 and held in place by musician 102 (not shown here).

Figure 25:
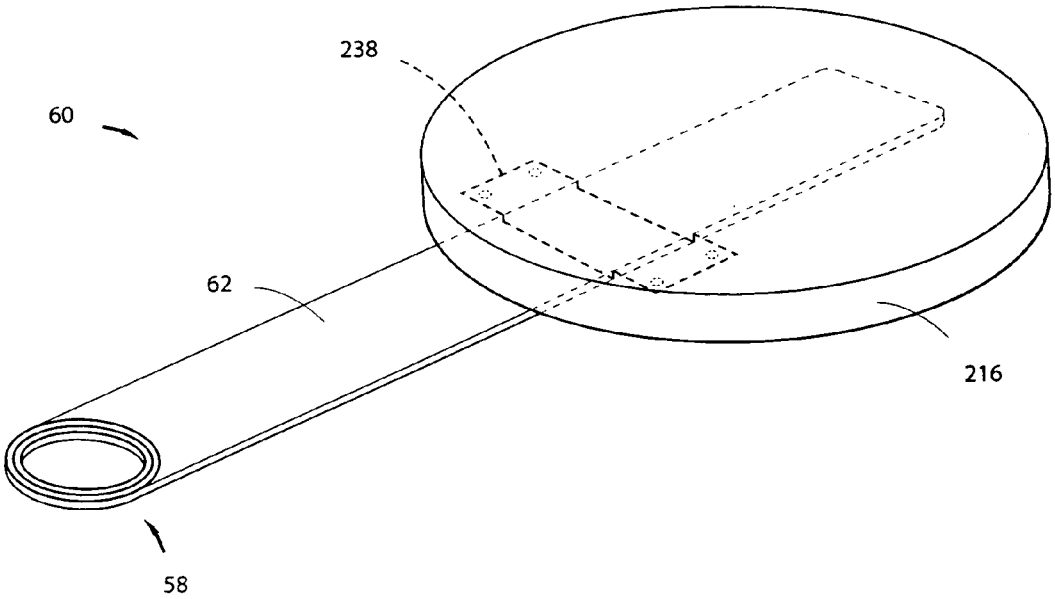

FIG. 25 (perspective view) shows an alternative way of interfacing support 60 with seat 216, using a first mount 238 screwed to bottom of seat 216 via screws (not numbered). Similar to the description in FIG. 24 the protrusion of support 60 is adjustable and the interface between support 60 and seat 216 is secured by friction when support 60 interfaces with instrument 10 (not shown here).

Thus the here-described interface provides another more convenient alternative to having support member 62 supported on top of seat 216 and held in place by musician 102 (not shown here).

Figure 26:
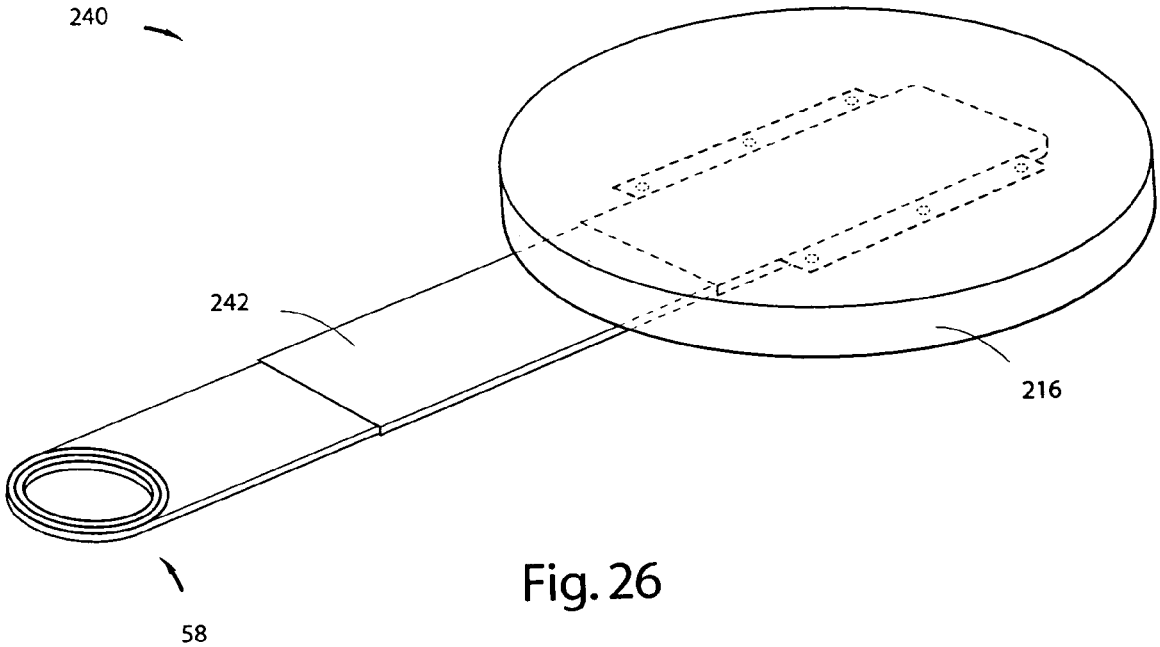
FIGS. 26 to 29 show alternative embodiments of the support of FIG. 5A used with the seat of a stool.

FIG. 26 (perspective view) shows a sixth alternative support 240 comprising a telescopic support member 242, screwed to bottom of seat 216 via screws (not numbered), and gimbal system 58. Support member 242 enables protrusion adjustment from seat 216 including complete retraction.

Figure 27:
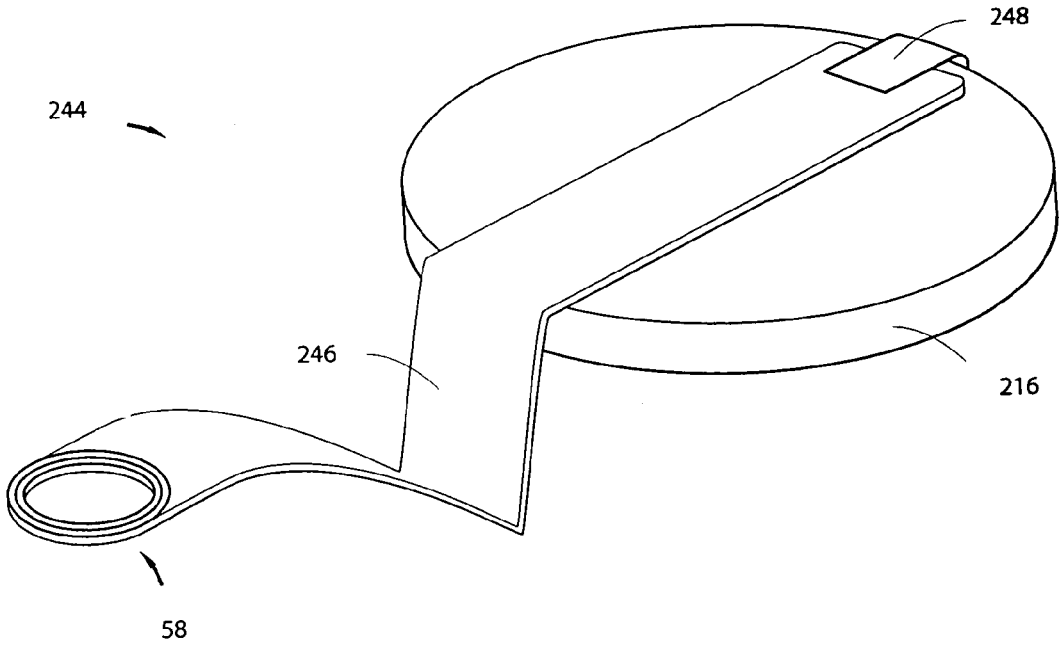

FIG. 27 (perspective view) shows a seventh alternative support 244 comprising a curved support member 246 for use with person wearing a skirt. Support 244 is attached to seat 216 via second mount 248. While offering described advantage support 244 does not offer protrusion adjustment from seat 216.

Figure 28:
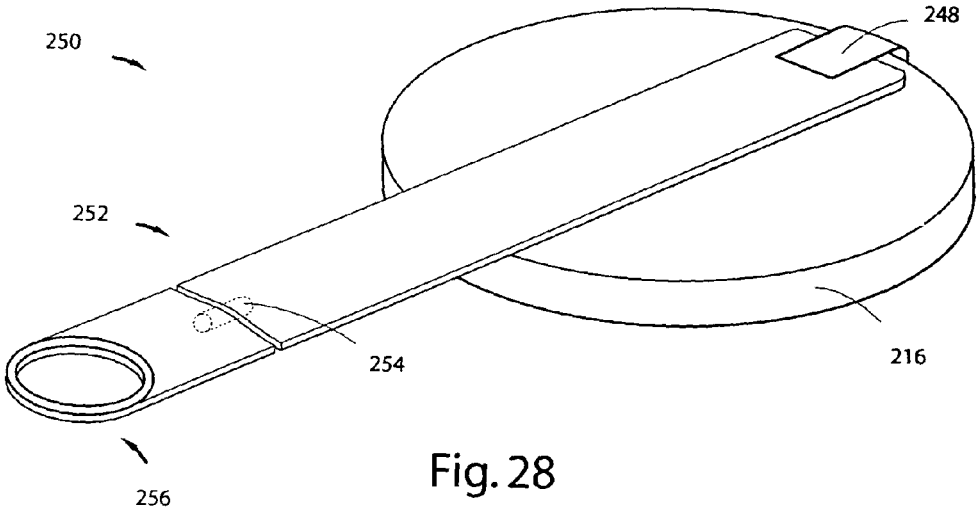

FIG. 28 (perspective view) shows an eighth alternative support 250 comprising a two-segment support member 252, segments pivotally connected by a pin 254, and a modified gimbal system 256. The function of median ring 68 of FIG. 5A is performed by support member 252, and thus median ring 68 is omitted at modified gimbal system 256. Support 250 is mounted to seat 216 via second mount 248.

Figure 29:
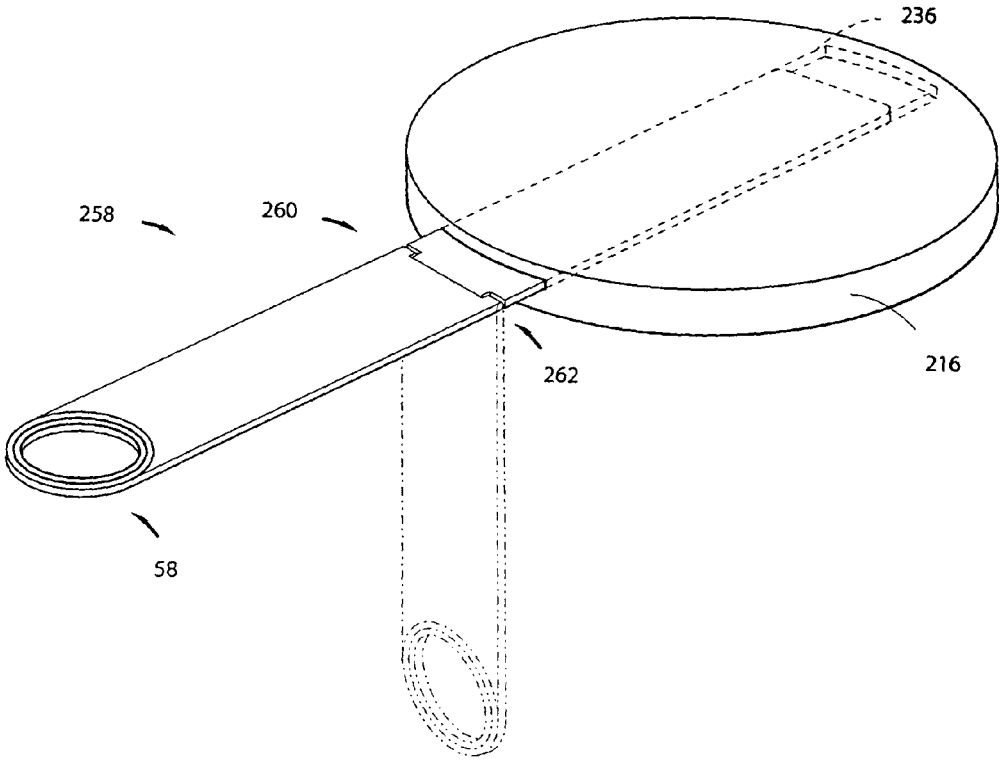

FIG. 29 (perspective view) shows a ninth alternative support 258 comprising a two-segment support member 260, segments connected by a hinge 262, and gimbal system 58. Hinge 262 comprises locking mechanism for keeping both segments of support member 260 aligned during, and enables folding of support member 260 for space economy after, operation. Similar to FIG. 24 support 258 interfaces with seat 216 via slot 236.

Figures 30A, 30B, 30C:
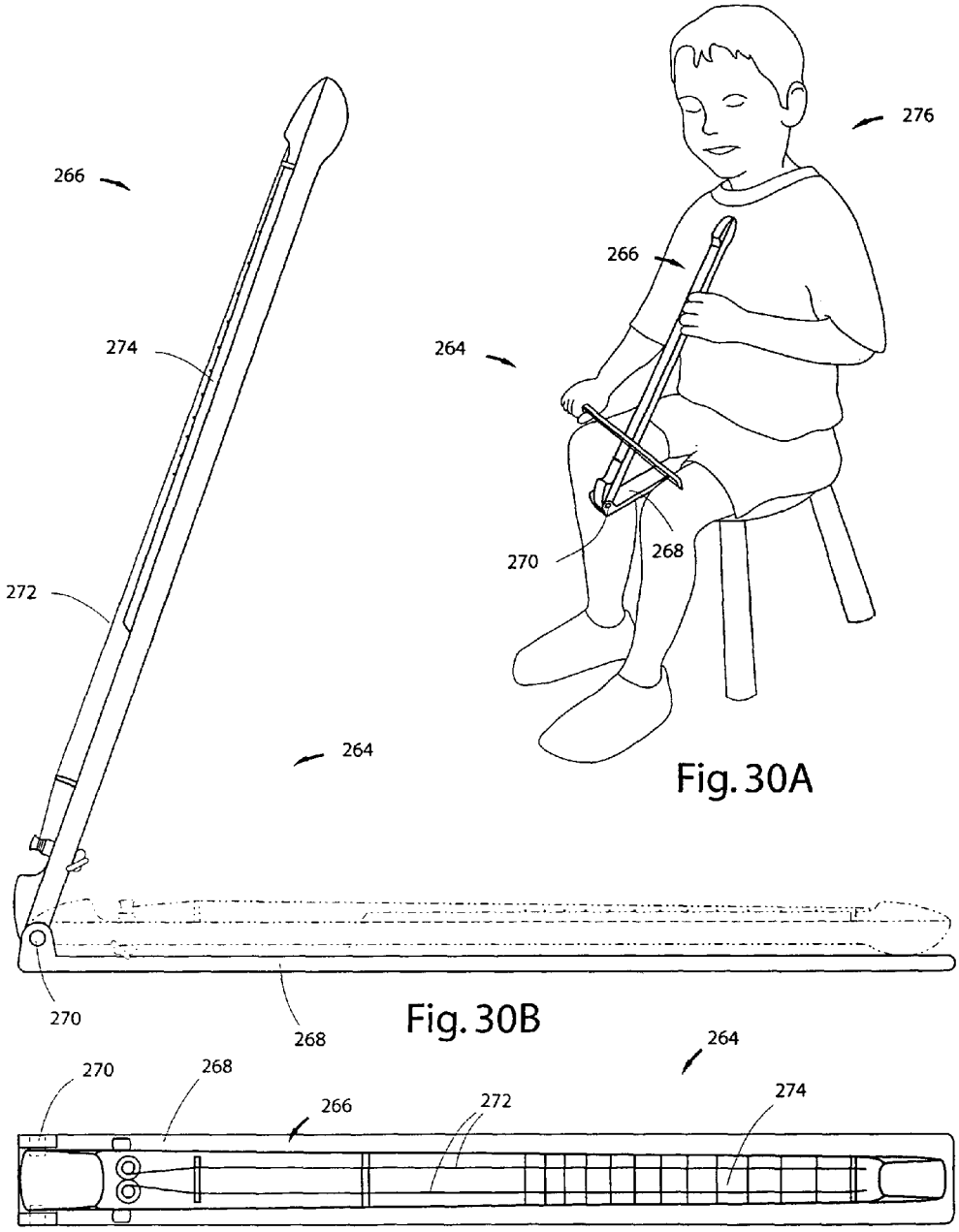
FIGS. 30A to 30C show different views of a simplified instrument-support unit, constructed in accordance with the teachings of the present invention.

FIGS. 30A (perspective view), 30B (side elevational view), and 30C (top plane view) show a small simplified instrument-support unit 264 having a simplified instrument 266 permanently connected to a simplified support 268 by a hinge 270, instrument 266 having two strings 272 and a fretted fingerboard 274 for use by a child 276. Hinge 270 enables both rotation of instrument 266 relative to support 268 for adjustment to the chest (not numbered) of child 276, and collapse (shown in phantom lines) of unit 264 for ease of handling. The bottom of support 268 is slightly convex (not shown) enabling instrument 266 to slightly pivot, congruently with the swaying torso motion of child 276.

Preferred Embodiment II

Figure 31A:
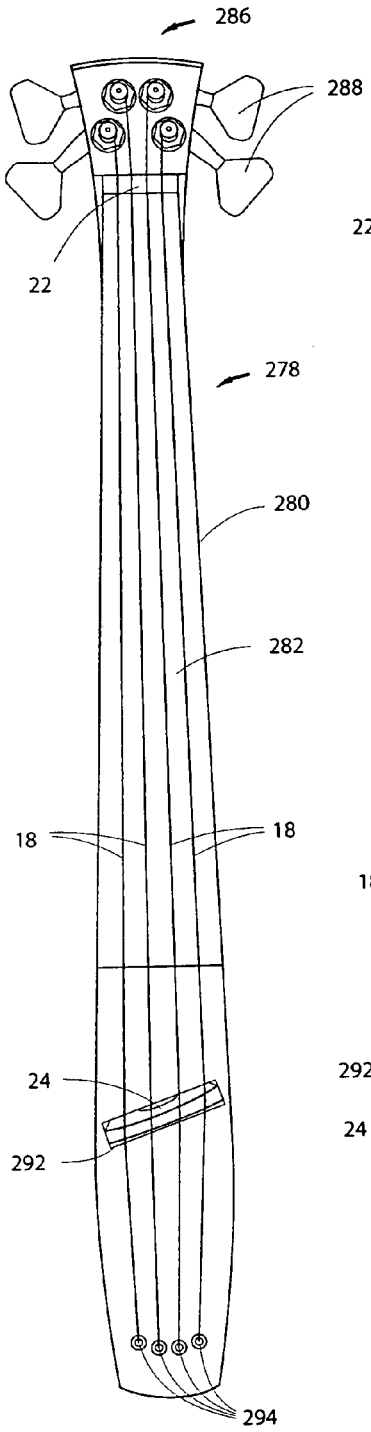
FIGS. 31A to 31C show different views of an alternative embodiment of the instrument of FIG. 1A.
Figure 31B:
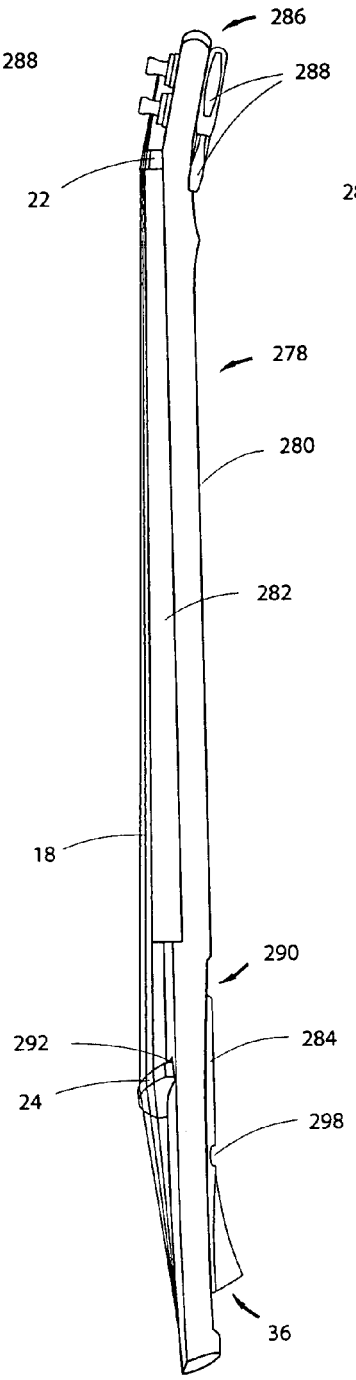

FIGS. 31A (front elevational view), 31B (side elevational view), and 31C (back elevational view) show an instrument 278 (generally indicated), being an alternative embodiment of instrument 10 of FIG. 1A. Instrument 278 comprises a body 280 made of aluminum alloy, a fingerboard 282 made of UHMW (ultra high molecular weight polypropylene), and an insert 284 (shown in more detail in FIGS. 32A and 32B) made of aluminum alloy, all connected magnetically (shown in detail in FIGS. 33A to 33D). Body 280 includes an economized head design 286 for receiving a set of bass guitar tuners 288, a cavity 290 (partially concealed by insert 284) for receiving insert 284, a slot 292 for receiving bridge 24, and a set of four holes 294 for receiving strings 18.

Figure 34A:
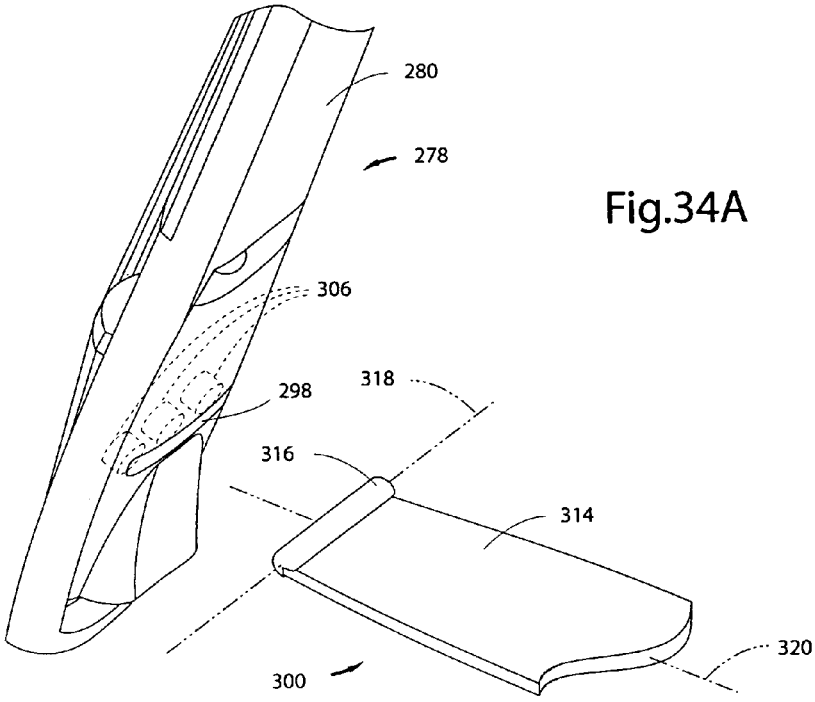
FIGS. 34A and 34B show an alternative embodiment of the support of FIG. 5A used with the instrument of FIG. 31A.
Figure 34B:
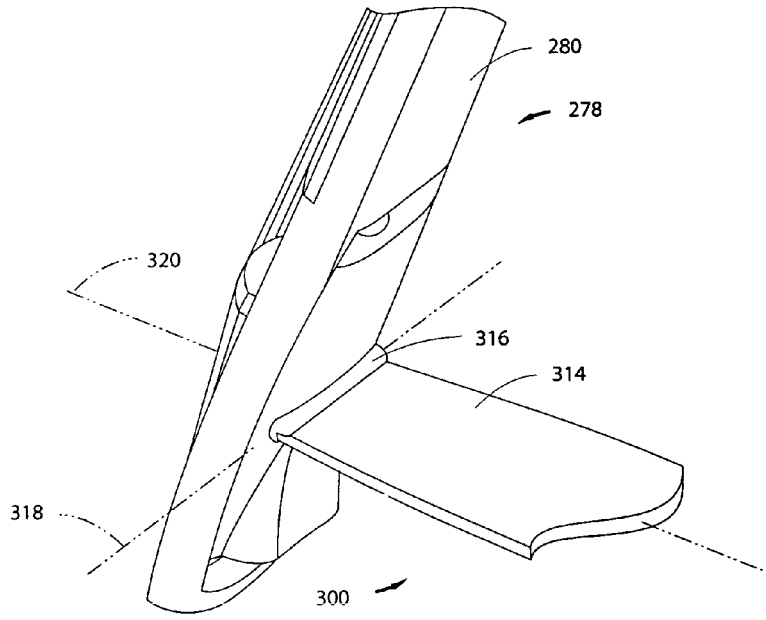

Insert 284 houses jack 36 and a potentiometer 296; insert 284 further includes a cavity 298 for interfacing with a support 300 (shown in FIGS. 34A and 34B).

Figure 31C:
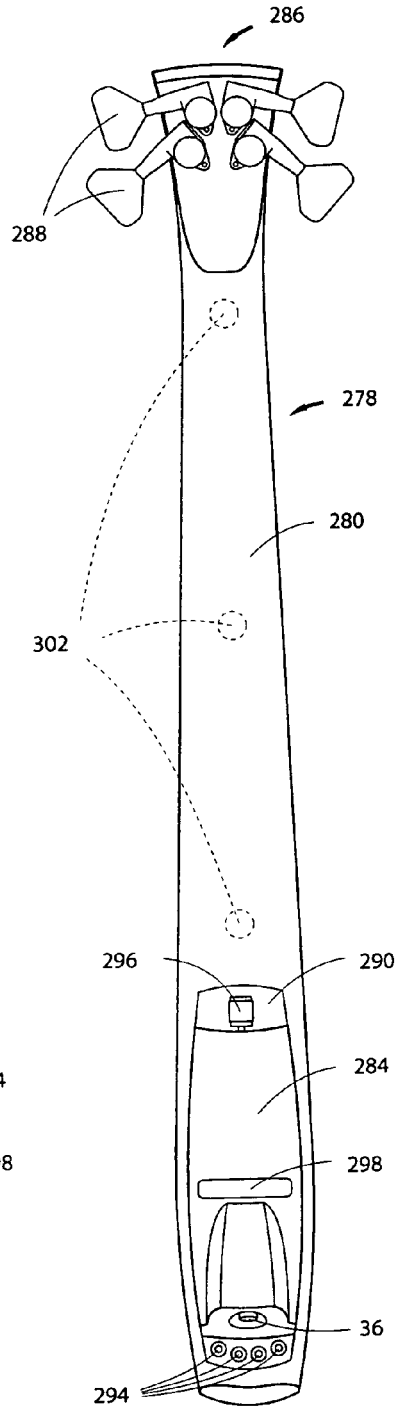

Strings 18 are suspended over fingerboard 282 by nut 22 and bridge 24 having a non-traditional orientation; strings 18 are held in tension by anchoring at holes 294 and tuners 288. FIG. 31C further shows the location of thin disc magnets 302 (shown in detail in FIG. 33A) used for connecting fingerboard 282 to body 280.

Figure 32A:
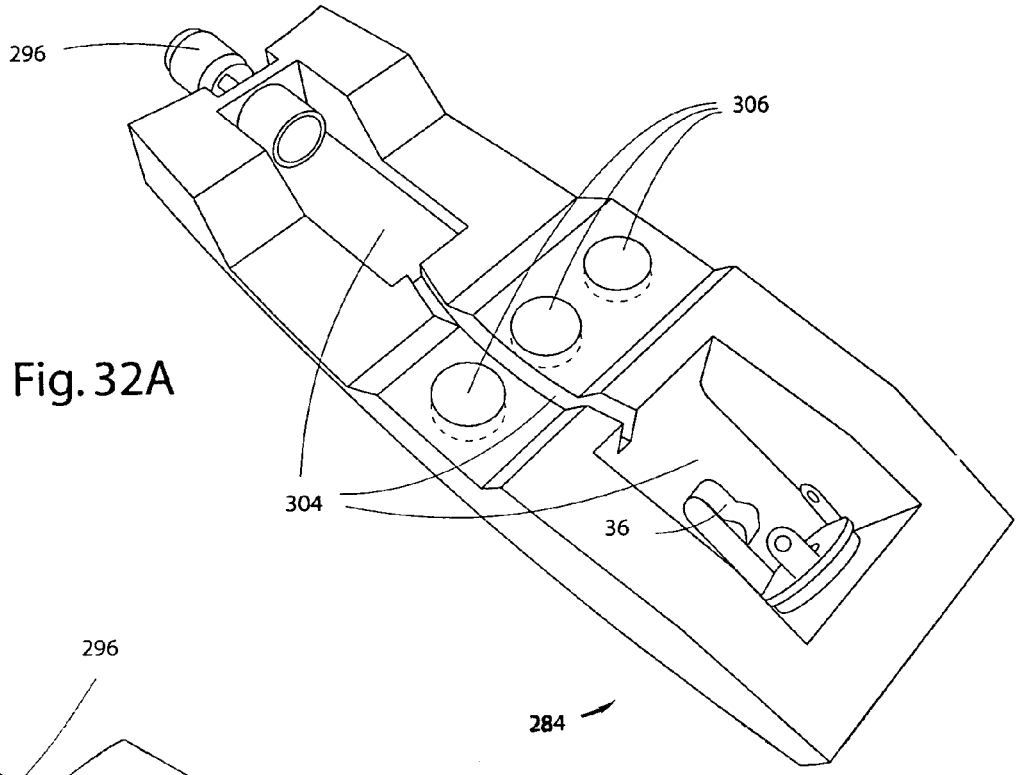
FIGS. 32A and 32B show different views of an insert for use with the instrument of FIG. 31A.
Figure 32B:
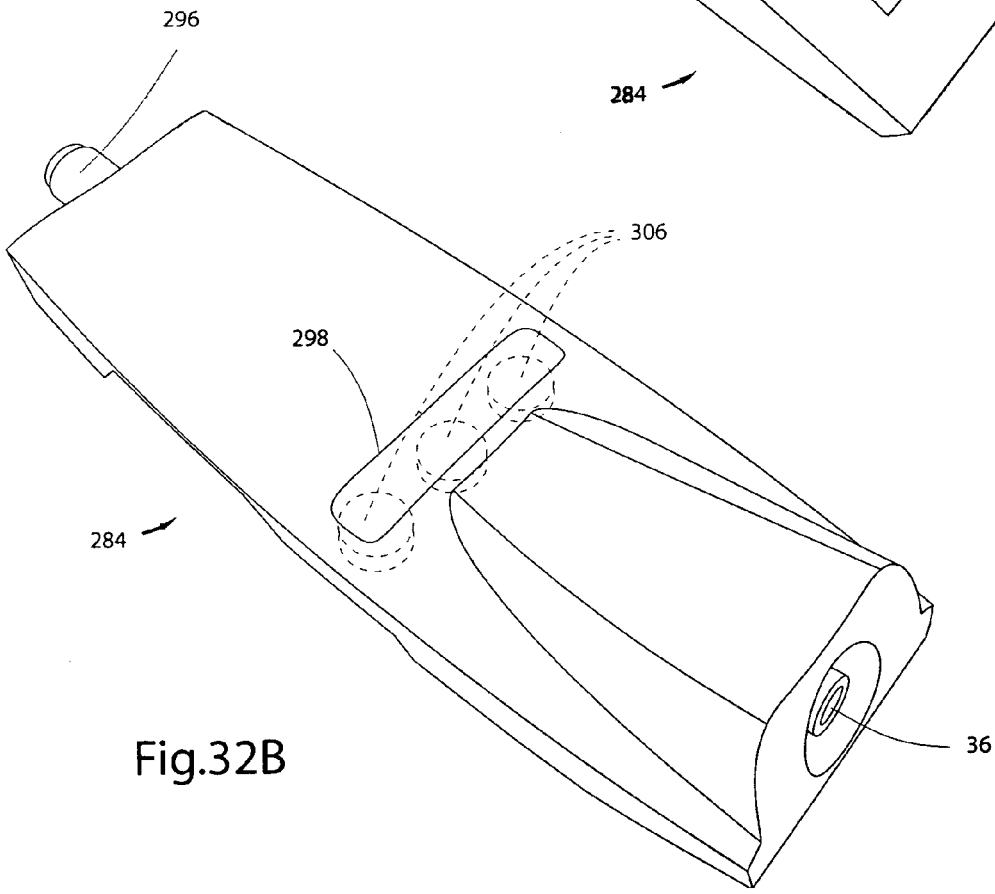

FIGS. 32A (top perspective view) and 32B (bottom perspective view) show insert 284 housing potentiometer 296 and jack 36; further shown is a complex cavity system 304 for housing wires (not shown) and for mounting of both jack 36 and potentiometer 296. Thick disc magnets 306 are held, by press fit, in holes (not numbered) close to cavity 298.

Figure 33A:
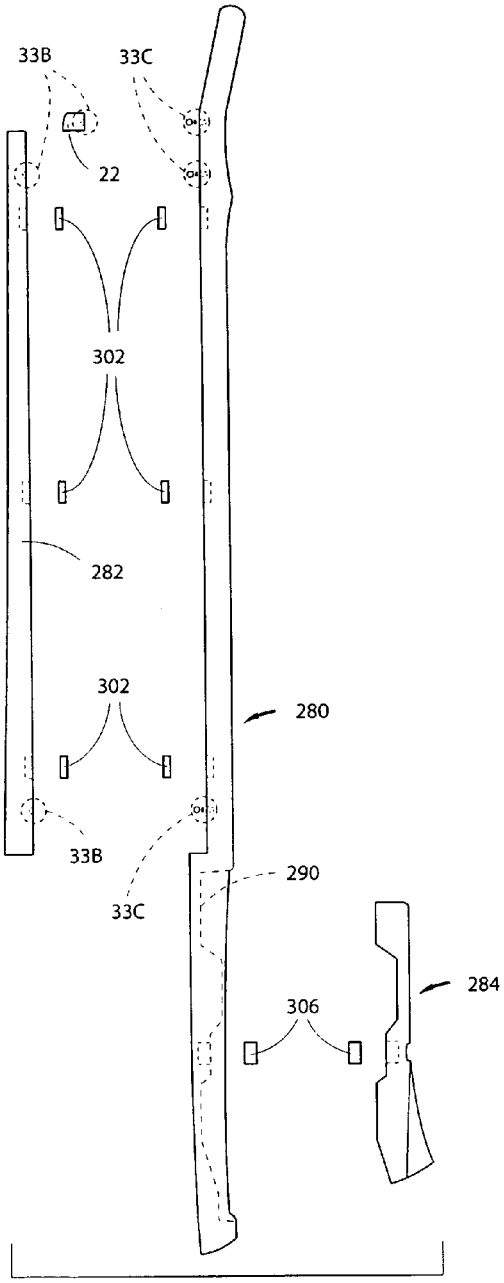
FIGS. 33A to 33D illustrate the assembly of the instrument of FIG. 31A.
Figure 33B:
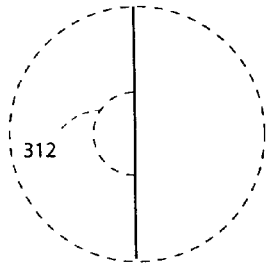
Figure 33C:
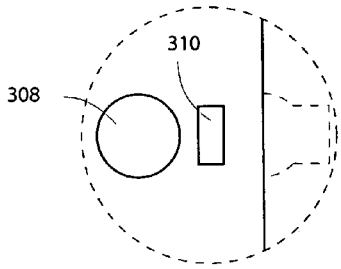
Figure 33D:
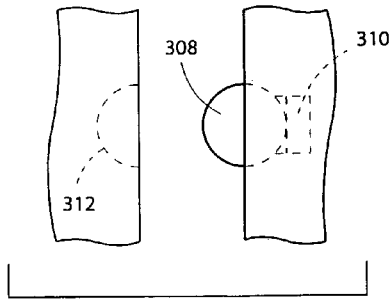

FIGS. 33A (exploded view), 33B (enlarged view), 33C (enlarged view), and 33D (side view) show the assembly of body 280, fingerboard 282, and insert 284 via thin disc magnets 302 and thick disc magnets 306. Both fingerboard 282 and nut 22 are aligned with body 280 by ball bearings 308 semi recessed into body 280 and held by mini disc magnets 310. The protruding hemispheres of bearings 308 fit into hemispherical recesses 312 in fingerboard 282 and nut 22 as shown in detail in FIG. 33D. Magnets 302, magnets 306, and magnets 310 are mounted via press fit.

FIGS. 34A and 34B (both perspective views) show support 300 comprising a support member 314 and a ferrous metal cylinder 316 for both interfacing with cavity 298 and for rotating instrument 278 around longitudinal axis 318 of cylinder 316; magnets 306 and ferrous metal cylinder 316 maintain the interface between support member 314 and instrument 278. Support member 314 is of a torsion bar design, thus allowing rotation of instrument 278 around longitudinal axis 320 of support member 314, and enabling spring-like reversion of instrument 278 to its original position. The system of instrument 278 and support 300 can collapse for ease of handling.

Figure 35A:
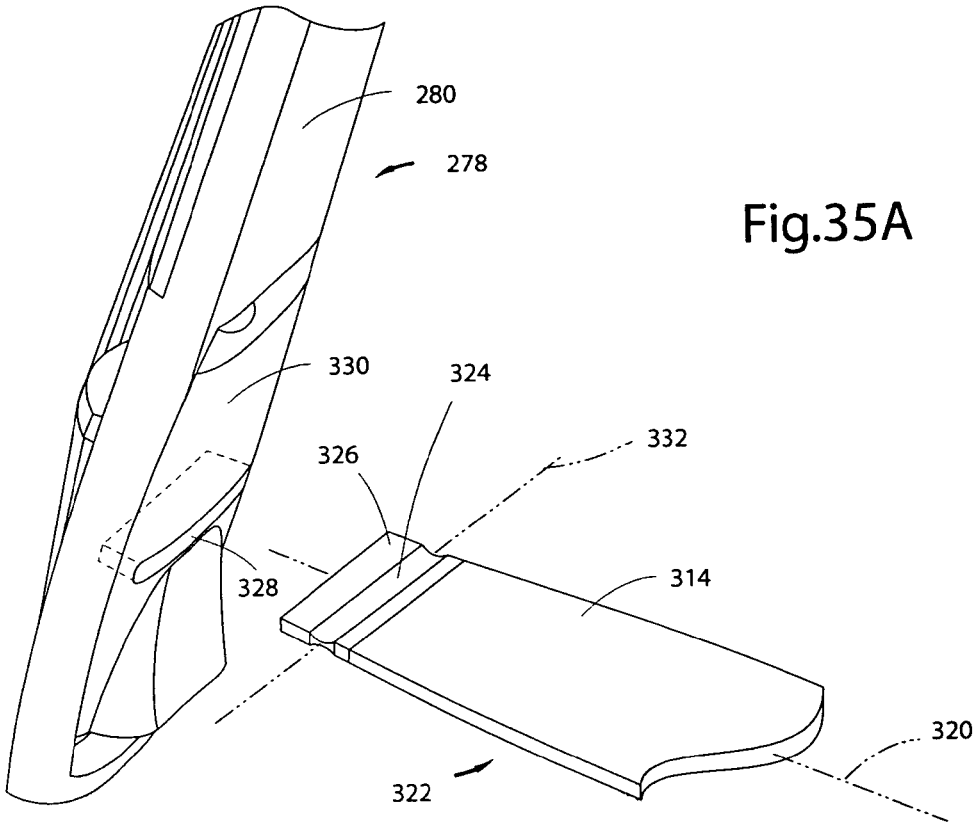
FIGS. 35A and 35B show an alternative embodiment of the support of FIG. 5A used with an alternative embodiment of the instrument of FIG. 31A.
Figure 35B:
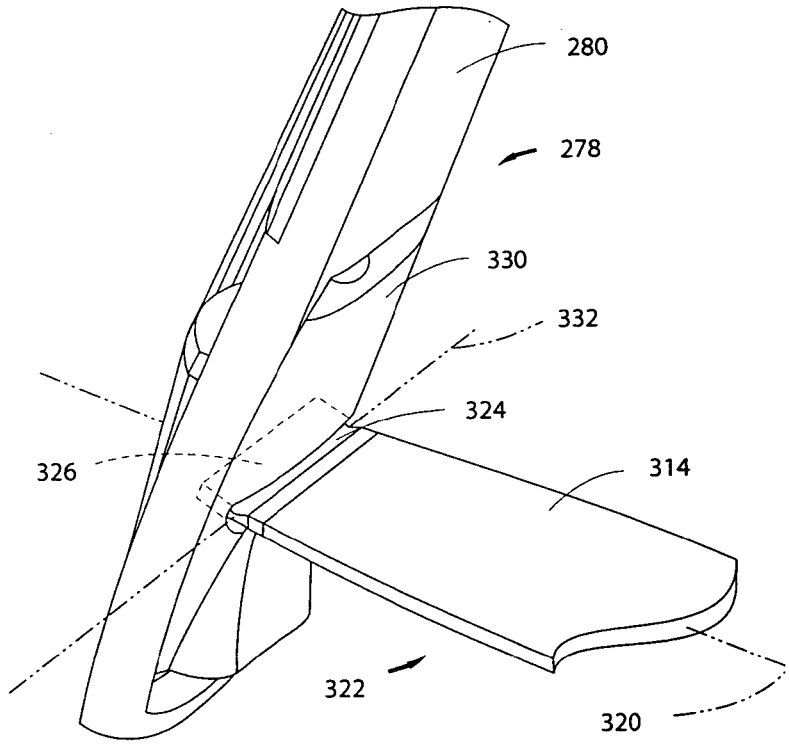

FIGS. 35A and 35B (both perspective views) show support 322 comprising support member 314 and a living hinge 324 having a tongue 326 for interfacing with groove 328 of modified insert 330. Living hinge 324 provides axis 332 for rotation of instrument 278. The interface between instrument 278 and support 322 is securely engaged when tongue 326 of living hinge 324 is bent upwards; the interface between instrument 278 and support 322 can be disengaged by relaxing living hinge 324 or bending tongue 326 downwards.

Support member 314 is of a torsion bar design, thus allowing rotation of instrument 278 around longitudinal axis 320 of support member 314, and enabling spring-like reversion of instrument 278 to its original position. The system of instrument 278 and support 322 can collapse for ease of handling.

Figure 36:
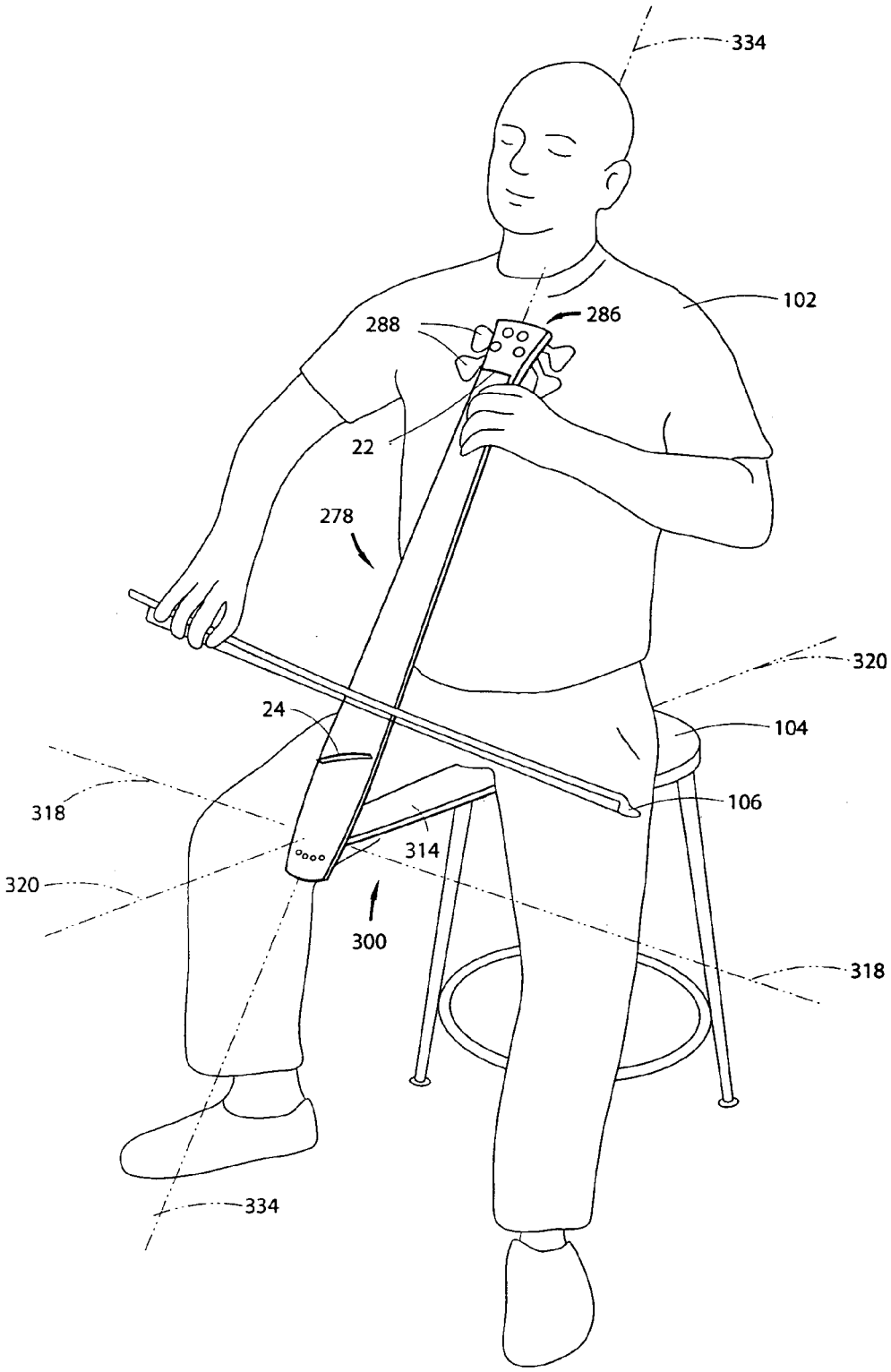
FIG. 36 shows the instrument of FIG. 31A being played by a seated musician using the support of FIG. 34A.

FIG. 36 (perspective view) shows a seated musician 102 playing instrument 278. Instrument 278 magnetically interfaces with support 300 via cylinder 316 (shown in FIGS. 34A and 34B); thus musician 102 can adjust instrument 278, its longitudinal axis 334 being on anatomical median plane 96 (shown in FIG. 7), for comfortably interfacing with the sternum via economized head design 286. Tuners 288 are located for comfortable tuning for the left hand of musician 102. Both nut 22 and bridge 24 are positioned providing a comfortable workspace for the left arm and bow arm of musician 102; both the distance between nut 22 and bridge 24, being greater than that of a viola and lesser than that of a cello, as well as the economized head design 286, reducing the distance between nut 22 and sternum during interface, enable the described ergonomic positioning of instrument 278.

Support member 314, interfacing with chair 104 provides longitudinal axis 320 for rotation of instrument 278 congruently (described in more detail in FIG. 8) with the torso of musician 102, further enabling spring-like reversion of instrument 278 via torsion-bar design. The interface between instrument 278 and support 300 further resists rotation around longitudinal axis 320, enabling freedom of motion for the legs of musician 102.

Advantages of instrument 278 further include modular fingerboard 282 for both simplifying the assembly process and enabling convenient interchange of either instrument 278 or fingerboard 282, as well as bridge 24 having a non-traditional orientation for both providing a more ergonomic fingerboard topology and for aligning known points of contact 120 (shown in FIG. 10).

Figure 37:
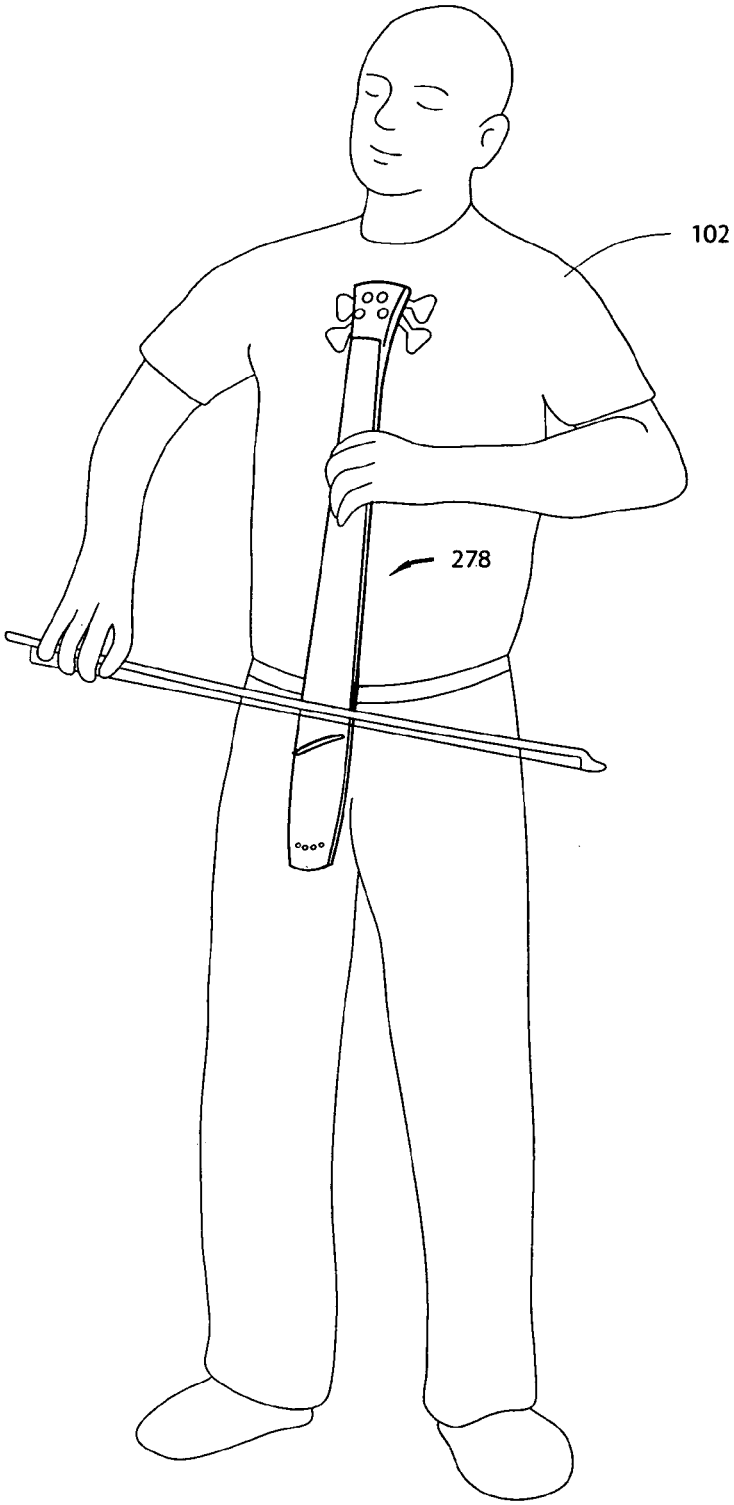
FIG. 37 shows the instrument of FIG. 31A being played by a standing musician.

FIG. 37 (perspective view) shows musician 102 standing and playing instrument 278, held by a support (not shown or numbered) close to the waist. Instrument 278 is positioned on anatomical median plane 96 (not shown) of musician 102 and able to move congruently with the swaying torso of musician 102, the position of instrument 278 being a function of the position of the musician's torso; while offering the ergonomic benefits described in FIG. 8 and FIG. 36, the entire weight of instrument 278 must be supported by musician 102 in FIG. 37.

All of the foregoing descriptions show the many components of the present invention. While each component has its special function in the entire system, and also offers advantages when used by itself, all components complement each other synergistically.

While the above description contains many specificities, these should not be construed as limitations on the scope of the invention, but rather as an exemplification of preferred embodiments thereof.

Ramifications

The Instrument
(a) can be electric or acoustic
(b) can be of different shape
(c) can be made using other materials
(d) can include a wireless transmitter
(e) can be fitted with a sensory fingerboard for omission of strings
(f) can be fitted with additional features such as a preamp, head phone jack, speakers, and lights
(g) can be fitted with a fretted fingerboard
(h) can have a fingerboard with fingering guide
(i) can include different accessories for further improving
(j) can have different tuning devices such as standard pegs and fine tuners
(k) can have different number of strings
(l) can be a plucked instrument
(m) can have different locations for some of the described parts such as jack, potentiometer, and string mount.

The Support
(a) can be made using different materials
(b) can be of different shape
(c) can be fitted with additional attachments such as pencil holder, cable mount, and instrument snap-on
(d) can include a handle
(e) can house elements such as a preamp, speakers, and head phone jack
(f) can include a compartment for storing a bow.

The Interface Between the Instrument and the Support
(a) can be permanent
(b) can be fitted with additional spring systems
(c) can utilize a different way of achieving the desired means for pivoting, such as mounting a gimbal system onto instrument.

The Interface Between Support and Chair
(a) can be permanent
(b) can be such that the support is integrated into chair
(c) can include a simple locking mechanism such as snap-on or bayonet mount.

Accordingly, the scope of the invention should be determined not by the embodiments illustrated, but by the appended claims and their legal equivalents.

The invention claimed is:

1. A stringed instrument, comprising:
(a) an elongated body,
(b) a fingerboard bounded by a nut and a bridge, said fingerboard further having a longitudinal axis,
(c) one or more strings suspended over said fingerboard between said nut and said bridge,
(d) a first means for supporting said body on or close to said axis close to or beyond said nut at the chest of a person playing said instrument, and
(e) a second means for supporting said body on or close to said axis close to or beyond said bridge,
whereby said first and said second means support said fingerboard close to or beyond its two ends, defined by said nut and said bridge, thus ensuring stability of said instrument for left hand operations on said fingerboard and eliminating the need to secure said instrument with the left hand of said person, and
whereby said first and said second means improve rotational stability of said instrument against disturbances of bow operations.

2. The stringed instrument of claim 1 wherein said second means supports said body close to said bridge,
whereby said second means reduces the effective weight of said instrument pushing against said person's chest, thus improving playing posture and technique.

3. The stringed instrument of claim 1 wherein said first means supports said body at the sternum of said person,
whereby said first means allows positioning of said fingerboard on the anatomical median plane of said person, thus improving playing posture and technique.

4. A seat-based instrument-support unit, comprising:
(a) a support member, a first part of said support member having a first means for interfacing with a seat, said seat bearing said support member, such that said first part of said support member is stationary relative to said seat,
(b) an instrument having an elongated body, said body having a longitudinal axis,
(c) a second means for interfacing said support member with said instrument, and
(d) a third means for restricting rotation of said instrument around said longitudinal axis,
whereby the orientation of said support member, and thus of said instrument, is a function of the orientation of said seat.

5. The seat-based instrument-support unit of claim 4 further having a fourth means for rotating said instrument around a second axis, said second axis being perpendicular to the anatomical median plane of a person sitting on said seat and playing said instrument,
whereby said instrument can be rotated around said second axis for adjustment relative to the body of said person.

6. The seat-based instrument-support unit of claim 5 wherein said fourth means is a living-hinge design, and wherein said second means is a tongue-and-groove design,
whereby the combination of both said living-hinge design and said tongue-and-groove design enables a secure interface between said support member and said instrument during operation, and
whereby said living-hinge design simplifies construction of said unit, thus economizing production, and
whereby said tongue-and-groove design simplifies construction of said unit, thus economizing production, and
whereby said tongue-and-groove design simplifies both assembly and disassembly of said unit.

7. The seat-based instrument-support unit of claim 5 wherein both said fourth means and said second means combined are a magnetic-hinge design, whereby said magnetic hinge joint eliminates the need for mechanical means of maintaining said interface, thus simplifying construction and reducing production cost, and whereby the process of joining said body and said support member is assisted magnetically, and thus simplified, and whereby the process of separating said body and said support member is simplified.

8. The seat-based instrument-support unit of claim 4 further having a fourth means for rotating said instrument around a second axis, said second axis being on or close to the anatomical horizontal plane of a person sitting on said seat and playing said instrument, and on or close to the anatomical median plane of said person, whereby said instrument can rotate around said second axis congruently with the swaying torso of said person, thus improving playing posture and technique.

9. The seat-based instrument-support unit of claim 8 further having a fifth means for spring-like reversion of said instrument to its original position after its rotation around said second axis, whereby said fourth means and said fifth means emulate the swaying torso motion of said person, thus further improving playing technique.

10. The seat-based instrument-support unit of claim 9 wherein said fifth means is a torsion-bar design.

11. A support for an instrument, comprising:

(a) a support member, a first part of said support member having a first means for interfacing with a base, said base bearing said support member, such that said first part of said support member is stationary relative to said base, a second part of said support member having a second means for interfacing with said instrument, (b) a primary means for rotating said instrument around a primary axis, said primary axis stationary relative to said first part of said support member, and (c) a secondary means for rotating said instrument around a secondary axis, said secondary axis being both perpendicular to said primary axis and stationary relative to said instrument, such that both said secondary axis and said instrument rotate around said primary axis via said primary means, whereby said secondary means enables adjustment of said instrument, when interfacing with said support member at said second part by said second means, relative to the torso of a musician, and whereby said primary means enables said instrument, when interfacing with said support at said second part by said second means, to move congruently with the torso motion of said musician, said torso motion defined as swaying within the anatomical coronal plane of said musician; said support is positioned on the anatomical median plane of said musician and perpendicular to the anatomical coronal plane of said musician; and said support is further positioned on or near the anatomical horizontal plane of said musician and aligned with the axis of said torso motion, and whereby said support prevents rotation of said instrument around the longitudinal axis of said instrument.

12. A musical instrument system, comprising:

(a) a body, (b) a support, (c) a first means for interfacing said body with the chest of a person, (d) a second means for interfacing said body with said support, (e) a third means for interfacing said support with a base, said base bearing said support such that a first part of said support is stationary relative to said base, and (f) a fourth means for enabling a position change of said body, such that said body can move congruently with the moving torso of said person, while said body interfaces with both said support and said person and while said support interfaces with said base, whereby the orientation of said body relative to said moving torso of said person is retained, facilitating freedom of torso motion while maintaining constancy of playing technique, independent of the position of said torso.

13. A stringed instrument, comprising:

(a) an elongated body having a first end, (b) a fingerboard bounded by a nut at or close to said first end and a bridge, said fingerboard further having a longitudinal axis, and (c) one or more strings suspended over said fingerboard between said nut and said bridge, the distance between said nut and said bridge greater than that of a viola and less than that of a cello, whereby said instrument can be played having said axis positioned on the anatomical median plane of a person playing said instrument, and whereby said instrument can be played having said nut positioned at or close to said person's chest, and whereby said instrument can be played having the entire length of said fingerboard visible to said person.

14. A non-fretted stringed instrument with non-traditional nut, comprising;

(a) a non-fretted fingerboard having a longitudinal axis, and (b) a nut positioned non-perpendicular to said axis, whereby said nut alters the traditional fingerboard topology close to said nut.

15. A non-fretted stringed instrument with non-traditional bridge, comprising;

(a) a non-fretted fingerboard having a longitudinal axis, and (b) a bridge positioned non-perpendicular to said axis, whereby said bridge alters the traditional fingerboard topology close to said bridge.

16. A stringed instrument with geared tuning system, comprising:

(a) a body, (b) a rotatable peg for tuning a sting, (c) a rotatable wheel having an outer rim, and (d) a gear operatively connecting said peg and said wheel such that rotation of said wheel results in rotation of said peg, said gear further having a ratio sufficient to enable tuning of said string by sliding a finger tangentially along said outer rim, whereby said string may be tuned by sliding a finger tangentially along the rim of said wheel, resulting in linear tuning motion.

17. A stringed instrument, comprising:

(a) an elongated body, (b) a fingerboard bounded by a nut and a bridge, said fingerboard further having a longitudinal axis, (c) one or more strings suspended over said fingerboard between said nut and said bridge, (d) a first support for supporting said body on or close to said axis close to or beyond said nut, the non-fingerboard side of said nut at the chest of a person playing said instrument, and (e) a second support for supporting said body on or close to said axis close to or beyond said bridge, the non-fingerboard side of said bridge, whereby said first and said second supports support said fingerboard close to or beyond its two ends, defined by said nut and said bridge, thus ensuring stability of said instrument for left hand operations on said fingerboard and eliminating the need to secure said instrument with the left hand of said person, and whereby said first and said second supports improve rotational stability of said instrument against disturbances of bow operations.

18. The stringed instrument of claim 17 wherein said second support supports said body close to said bridge, whereby said second support reduces the effective weight of said instrument pushing against said person's chest, thus improving playing posture and technique.

19. The stringed instrument of claim 17 wherein said first support supports said body at the sternum of said person, whereby said first support allows positioning of said fingerboard on the anatomical median plane of said person, thus improving playing posture and technique.

20. A seat-based instrument-support unit, comprising:

(a) a support member, a first part of said support member having a first connector for interfacing with a seat, said seat bearing said support member, such that said first part of said support member is stationary relative to said seat, (b) an instrument having an elongated body, said body having a longitudinal axis, and (c) a second connector for interfacing said support member with said instrument such that it restricts rotation of said instrument around said longitudinal axis, whereby the orientation of said support member, and thus of said instrument, is a function of the orientation of said seat.

21. The seat-based instrument-support unit of claim 20 further having a pin joint for rotation of said instrument around a second axis, said second axis being perpendicular to the anatomical median plane of a person sitting on said seat and playing said instrument, whereby said instrument can be rotated around said second axis for adjustment relative to the body of said person.

22. The seat-based instrument-support unit of claim 21 wherein said second axis is on or close to the anatomical horizontal plane of said person.

23. The seat-based instrument-support unit of claim 20 further having a pin joint for rotating said instrument around a second axis, said second axis being on or close to the anatomical median plane and perpendicular to the anatomical coronal plane of said person.

24. The seat-based instrument-support unit of claim 23 wherein said second axis is on or close to the anatomical horizontal plane of a person sitting on said seat and playing said instrument, whereby said instrument can rotate around said second axis congruently with the swaying torso of said person, thus improving playing posture and technique.

25. The seat-based instrument-support unit of claim 23 further having a "spring" system for spring-like reversion of said instrument to its original position after its rotation around said second axis.

26. A support for an instrument with elongated body, comprising:

(a) a support member, a first part of said support member having a first connector for interfacing with an instrument, a second part of said support member having a second connector for interfacing with a base, said base bearing said support member, such that said second part of said support member is stationary relative to said base, (b) a primary pin joint for rotating said instrument around a primary axis, said primary axis stationary relative to said first pan of said support member, said primary axis also substantially intersecting with the longitudinal axis of said instrument, and (c) a secondary pin joint for rotating said instrument around a secondary axis, said secondary axis being both perpendicular to said primary axis and stationary relative to said instrument, such that both said secondary axis and said instrument rotate around said primary axis via said primary pin joint, said secondary axis also being perpendicular to the longitudinal axis of said instrument, and said secondary axis also substantially intersecting with the longitudinal axis of said instrument, whereby said secondary pin joint enables adjustment of said instrument, when interfacing with said support member via said first connector, relative to the torso of a musician, and whereby said primary pin joint enables said instrument, when interfacing with said support via said first connector, to move congruently with the torso motion of said musician, said torso motion defined as swaying within the anatomical coronal plane of said musician; said support is positioned having said primary axis on the anatomical median plane and perpendicular to the anatomical coronal plane of said musician; and said support is further positioned having said primary axis on or near the anatomical horizontal plane of said musician and aligned with the axis of said torso motion, and whereby said support prevents rotation of said instrument around the longitudinal axis of said instrument.

27. The support of claim 26 wherein said primary axis and said secondary axis intersect substantially.

28. A musical instrument system, comprising:

(a) an instrument body, (b) a support, (c) a rest for interfacing said body with the chest of a person, (d) a first connector for interfacing said body with said support, (e) a second connector for interfacing said support with a base, said base bearing said support such that a part of said support is stationary relative to said base, and (f) a pivot system for enabling a position change of said body, such that said body can move congruently with the moving torso of said person, while said body interfaces with both said support and said person and while said support interfaces with said base, whereby the orientation of said body relative to said moving torso of said person is retained, facilitating freedom of torso motion while maintaining constancy of playing technique, independent of the position of said torso.

29. A stringed instrument with non-traditional nut-bridge orientation, comprising;

(a) a fingerboard having a longitudinal axis, and (b) a nut positioned non-perpendicular to said axis, (c) a bridge positioned parallel to said nut, whereby the non-traditional orientation of said nut and said bridge alters the traditional fingerboard topology.

* * * * *